US008726881B2

(12) United States Patent
Sato et al.

(10) Patent No.: US 8,726,881 B2
(45) Date of Patent: May 20, 2014

(54) INLET PASSAGE STRUCTURE OF V-TYPE INTERNAL COMBUSTION ENGINE

(75) Inventors: Toshiyuki Sato, Saitama (JP); Masaki Cho, Saitama (JP); Natsue Ogawa, Saitama (JP); Takahiro Imafuku, Saitama (JP); Kaoru Hanawa, Saitama (JP); Noriaki Okano, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 1104 days.

(21) Appl. No.: 12/723,494

(22) Filed: Mar. 12, 2010

(65) Prior Publication Data

US 2010/0242903 A1 Sep. 30, 2010

(30) Foreign Application Priority Data

Mar. 27, 2009 (JP) ..... 2009-080536
Mar. 27, 2009 (JP) ..... 2009-080538
Mar. 27, 2009 (JP) ..... 2009-080541
Nov. 19, 2009 (JP) ..... 2009-263683

(51) Int. Cl.
*F02M 35/116* (2006.01)
*F02M 35/10* (2006.01)

(52) U.S. Cl.
USPC ..... 123/337; 123/184.31

(58) Field of Classification Search
USPC ..... 123/337, 184.31, 54.4, 55.2, 184.34, 123/184.35, 399
See application file for complete search history.

(56) References Cited

U.S. PATENT DOCUMENTS

| | | | | |
|---|---|---|---|---|
| 1,691,114 | A * | 11/1928 | Francis et al. | 123/547 |
| 5,269,266 | A * | 12/1993 | Kageyama et al. | 123/65 B |
| 6,092,503 | A * | 7/2000 | Ohsuga et al. | 123/308 |
| 6,408,809 | B2 * | 6/2002 | Suzuki | 123/184.31 |
| 2001/0029917 | A1 * | 10/2001 | Suzuki | 123/184.31 |
| 2002/0023606 | A1 | 2/2002 | Schneider | |
| 2005/0172925 | A1 | 8/2005 | Kurosawa | |
| 2006/0207527 | A1 * | 9/2006 | Saeki et al. | 123/54.4 |
| 2007/0199543 | A1 | 8/2007 | Inui | |
| 2007/0240681 | A1 * | 10/2007 | Miyashita et al. | 123/399 |
| 2008/0035090 | A1 | 2/2008 | Suzuki et al. | |
| 2008/0078349 | A1 | 4/2008 | Kudo et al. | |
| 2010/0242871 | A1 * | 9/2010 | Sato et al. | 123/54.4 |

FOREIGN PATENT DOCUMENTS

| | | | |
|---|---|---|---|
| DE | 102007027954 | A1 | 2/2008 |
| JP | 3-23315 | A | 1/1991 |
| JP | 5-83337 | U | 11/1993 |
| JP | 6-299936 | A | 10/1994 |
| JP | 8-193546 | A | 7/1996 |
| JP | 08-338253 | A | 12/1996 |
| JP | 2004-28081 | A | 1/2004 |

(Continued)

*Primary Examiner* — Mahmoud Gimie
(74) *Attorney, Agent, or Firm* — Birch, Stewart, Kolasch & Birch, LLP

(57) ABSTRACT

In the inlet passage structure of the V-type internal combustion engine, front and rear banks have inlet ports with a nearly identical inlet passage length, and an inlet chamber is connected to a top end openings of the inlet ports. A throttle body and the inlet chamber are offset on a side leading to a cylinder on a side away from the throttle body. The inside of the inlet chamber is formed with a nearly straight inlet passage from the throttle body to the top end opening of the inlet port leading to the cylinder bore on the side away from the throttle body, and a curved inlet passage to the top end opening of the inlet port leading to the cylinder on a close side.

20 Claims, 12 Drawing Sheets

(56) References Cited

FOREIGN PATENT DOCUMENTS

| | | | |
|---|---|---|---|
| JP | 2005-36681 | A | 2/2005 |
| JP | 2005-207254 | A | 8/2005 |
| JP | 2007-231793 | A | 9/2007 |
| JP | 2008-88877 | A | 4/2008 |

* cited by examiner

FI.G 1

INLET PASSAGE STRUCTURE OF V-TYPE INTERNAL COMBUSTION ENGINE

CROSS-REFERENCE TO RELATED APPLICATION

The present application claims priority under 35 U.S.C. §119 to Japanese Patent Application Nos. 2009-080541, 2009-080536, and 2009-080538 filed on Mar. 27, 2009, and Japanese Patent Application No. 2009-263683 filed Nov. 19, 2009, the entire contents of which are hereby incorporated by reference.

BACKGROUND OF THE INVENTION

1. Field of the Invention

The present invention relates to an inlet passage structure of a V-type internal combustion engine having an inlet chamber at the downstream of a throttle body.

2. Description of Background Art

As an internal combustion engine, there has heretofore been an engine that attempts to improve engine output and engine response by disposing a tank-type inlet chamber in an inlet passage between a throttle body and an inlet pipe; relieving the pressure variation (pulsation) of inlet air in the inlet passage with the inlet chamber; and improving an inlet efficiency. (Refer to JP-A No. H8-338253, for example.)

Meanwhile, in the apparatus disclosed in JP-A No. H8-338253, when a pair of front and rear banks are disposed in the shape of V, two connecting rods of the front and rear banks are connected to a common crankshaft in the manner of being offset from each other in the axial direction of the crankshaft and hence the cylinders of the front and rear banks are offset from each other in the axial direction of the crankshaft. Consequently, when a throttle body common to the front and rear banks is disposed, since the lengths of inlet passages extending from the throttle body to combustion chambers of the front and rear banks are different from each other, difference in inlet air volume occurs between the combustion chambers and a required performance is hardly outputted because of the unbalance of output between the cylinders.

JP-A No. 2005-207254, for example, discloses another internal combustion engine having a variable valve mechanism wherein the phase/lift of a camshaft is variable. In such a variable valve mechanism, one inlet valve and one exhaust valve are driven by one camshaft.

JP-A No. 2005-36681, for example, discloses a V-type internal combustion engine having a pair of front and rear banks disposed in the shape of V, there is an internal combustion engine of a cylinder injection type to inject a fuel directly from an injector as a fuel injection device into a combustion chamber. In such an internal combustion engine, a bank angle between a front bank and a rear bank is set at a narrow angle of 45 to 50 degrees and the inlet ports of the front and rear banks are disposed inside the V bank.

Meanwhile, in the case of the internal combustion engine described in JP-A No. 2005-207254, since the numbers of the inlet and exhaust valves are one each, the inlet and exhaust efficiency cannot be increased so much and output is also restricted.

As a means for overcoming the problems, it may be possible to dispose camshafts for inlet and exhaust individually and drive two valves for inlet and exhaust with one of the camshafts, namely four valves in total as described in JP-A No. 2005-36681. In this case however, the width of a cylinder head in the anteroposterior direction increases, the space inside the V bank reduces, injectors cannot be disposed inside the V bank, and thus the injectors have to be disposed at the center portions of the cylinders as shown in JP-A No. 2005-36681. For that reason, the direction of fuel injection, the ignition plug attaching location, and the like are restricted. JP-A No. 2005-36681 discloses that fuel is injected directly from an injector as a fuel injection device into a combustion chamber. In such an internal combustion engine, a nip angle (a bank angle) between a front bank and a rear bank is set at a narrow angle of 45 to 50 degrees and the inlet ports of the front and rear banks are disposed inside the V bank.

Meanwhile, in the case of a cylinder injection type internal combustion engine, it is desirable to dispose an injector on an inlet port side in the manner of laying down the injector away from the cylinder axis of a bank in order to improve ignitability or the like.

By a previous configuration however, the bank angle is too narrow to dispose the injector inside the V bank that is on the inlet port side and it is impossible to carry out operations such as the attachment or the detachment of the injector. Consequently, there has been no other way than to dispose the injector in the manner of standing up along the cylinder axis and thus it has been impossible to dispose the injector at the most appropriate place.

SUMMARY AND OBJECTS OF THE INVENTION

One object of the present invention is to provide an inlet passage structure of a V-type internal combustion engine having an identical inlet passage length. Another object of the present invention is to provide a compact V-type internal combustion engine that makes it possible to obtain a high output by adopting a four-valve engine having a high inlet and exhaust efficiency; and dispose injectors while inlet passages are secured inside the V bank. Another object of the present invention is to allow a fuel injection device to be disposed at the most appropriate place, as well as to facilitate attachment or detachment of the fuel injection device.

According to an embodiment of the present invention, an inlet passage structure is provided for a V-type internal combustion engine having a pair of front and rear banks disposed in a shape of V, an inlet chamber at the downstream of a throttle body commonly shared by the front and rear banks, and an inlet pips branched from the inlet chamber to a combustion chamber of each of the front and rear banks. Each of the front and rear banks has an inlet port having nearly identical inlet passage length and the inlet chamber is connected to a top end opening of the inlet port; the throttle body and the inlet chamber are offset on a side leading to a cylinder on a side away from the throttle body. The inlet chamber is formed with, in its inside, a nearly straight inlet passage from the throttle body to the top end opening of the inlet port leading to the cylinder on the side away from the throttle body and a curved inlet passage to the top end opening of the inlet port leading to a cylinder on the close side.

By the above configuration, it is possible to equalize the lengths of the inlet passages of the front and rear banks.

In the inlet passage structure of a V-type internal combustion engine described above, the throttle body may have an actuator to control the degree of the opening of the throttle on a side opposite to a direction of the offset.

By the above configuration, the actuator is disposed in a wide space formed by the offset and hence the operation of attaching the actuator is facilitated.

According to an embodiment of the present invention, a V-type internal combustion engine having a cylinder block is disposed in a shape of V and an inlet port disposed inside a V bank and injecting a fuel directly from an injector disposed below the inlet port into combustion a chamber. A camshaft is disposed independently for inlet and exhaust in a cylinder head on each cylinder block. A rocker arm to drive an inlet and exhaust valve by driving force transferred from a camshaft is disposed; and a rocker arm pivot of the rocker arm is disposed on a center side of the cylinder head.

By the above configuration, since the rocker arms are moved toward the center sides of the cylinder heads and the lengths of the cylinder heads in the direction of the inlet and exhaust ports can be reduced, it is possible to expand the space between the banks and dispose the injectors while inlet passages are secured inside the V bank.

In the above V-type internal combustion engine, the end of the rocker arm on the center side may be notched along a shape of a plug hole for an ignition plug.

By the above configuration, since the rocker arms are further moved toward the center sides of the cylinder heads and the lengths of the cylinder heads in the direction of the inlet and exhaust ports can further be reduced, it is possible to further expand the space between the banks and facilitate the operations such as the attachment or the detachment of the injectors without detaching the cylinder heads.

In the above V-type internal combustion engine, the inlet port may have a lower inlet port disposed integrally with a cylinder head and an upper inlet port disposed not integrally with the cylinder head; and the upper inlet port may be attached to the lower inlet port in the manner of changing an angle to a direction closer to a head cover on the cylinder head.

By the above configuration, since the inlet port has the lower inlet port disposed integrally with a cylinder head and an upper inlet port disposed not integrally with the cylinder head, it is possible to detach the upper inlet port from the cylinder head and facilitate the operations such as the attachment or the detachment of the injector. Further, since the upper inlet port is attached to the lower inlet port in the manner of changing the angle to a direction closer to the head cover on the cylinder head, it is possible to expand the space between the banks and facilitate the operations such as the attachment or the detachment of the upper inlet port.

According to an embodiment of the present invention, a V-type internal combustion engine having a pair of front and rear banks is disposed in a shape of V and an inlet port of each of front and rear banks inside a V bank of the front and rear banks. The inlet port has a lower inlet port integrated with a cylinder head and an upper inlet port not integrated with the cylinder head and connected to a top end of the lower inlet port; and the upper inlet port extends in the manner of changing an angle to a direction closer to a head cover of the cylinder head.

By the above configuration, since the inlet port has the lower inlet port disposed integrally with the cylinder head and an upper inlet port disposed not integrally with the cylinder head, it is possible to detach the upper inlet port from the cylinder head for example and hence operations such as the attachment or the detachment of a fuel injection device can be carried out even though a bank angle is narrow. Further, since the upper inlet port extends in the manner of changing the angle to a direction closer to the head cover of the cylinder head, it is possible to expand the space between the banks.

In the above V-type internal combustion engine, the upper inlet ports of the paired front and rear banks may extend upward nearly parallel with each other and an inlet chamber disposed inside the V bank may be connected to the top end of each upper inlet port.

By the above configuration, since the top end of the upper inlet port connected to the inlet chamber is disposed at the upper part inside the V bank having a larger space, it is possible to easily dispose the inlet chamber even though the bank angle is narrow. Further, by changing the lengths of the paired front and rear upper inlet ports from each other for example, it is possible to inhibit gaps and stress from occurring at the interface between the paired front and rear upper inlet ports and the inlet chamber.

In the above V-type internal combustion engine, the fuel injection device may be disposed below and along the lower inlet port.

By the above configuration, since the fuel injection device is disposed below the lower inlet port, the fuel injection device is disposed on the inlet port side in the manner of being laid down away from a cylinder axis, and hence ignitability or like improves. Further, since the fuel injection device is disposed along the lower inlet port, it is possible to inhibit the fuel injection device from protruding from the bank; and downsize the bank.

In the above V-type internal combustion engine, one of the upper inlet ports of the paired front and rear banks may be formed of an elastic member.

By the above configuration, since the elastic member is elastically deformed, it is possible to further absorb difference in level and angle of the interface between the paired front and rear inlet ports and the inlet chamber.

In the above V-type internal combustion engine, at least a part of one of the upper inlet ports of the paired front and rear banks may be formed of the elastic member.

By the above configuration, it is possible to further absorb difference in level and angle of the interface between the paired front and rear inlet ports and the inlet chamber while ensuring necessary rigidity of the upper inlet port.

In the above V-type internal combustion engine, the upper inlet port may be vertically divided into two and the elastic member may be formed between the divided inlet ports.

By the above configuration, since the elastic member is vertically elastically deformed, it is possible to easily adjust vertical length of the upper inlet port.

In the above V-type internal combustion engine, the elastic member may be formed by burning rubber on a surface of metal.

By the above configuration, since the elastic member is integrated with the upper inlet port, it is possible to handle the upper inlet port as one component.

Effects of the invention include the following:

By the present invention, the front and rear banks have inlet ports having nearly identical inlet passage length and the inlet chamber is connected to top end openings of the inlet ports; the throttle body and the inlet chamber are offset on the side leading to a cylinder on the side away from the throttle body. The inlet chamber is formed with, in its inside, the nearly straight inlet passage from the throttle body to the top end opening of the inlet port leading to the cylinder on the side away from the throttle body and the curved inlet passage to the top end opening of the inlet port leading to a cylinder on the close side. Consequently, it is possible to equalize the inlet passage lengths of the front and rear banks; resultantly equalize the performance of the cylinders; and improve the performance of the internal combustion engine.

Further, since the throttle body has the actuator to control the degree of the opening of the throttle on the side opposite to the direction of the offset, the actuator is disposed in a wide space formed by the offset and hence the operation of attaching the actuator is facilitated.

By the present invention, since camshafts are disposed independently for inlet and exhaust in a cylinder head on each of the cylinder blocks; rocker arms to drive inlet and exhaust valves by the driving force transferred from the camshafts are disposed; and rocker arm pivots of the rocker arms are disposed on the center sides of the cylinder heads, even when the output is increased as a four-valve engine for example, it is possible to move the rocker arms toward the center sides of the cylinder heads; reduce the lengths of the cylinder heads in the direction of the inlet and exhaust ports; hence expand the space between the banks; and dispose the injectors while inlet passages are secured inside the V bank.

Further, since the ends of the rocker arms on the center sides are notched along the shape of a plug hole for an ignition plug, it is possible to further move the rocker arms toward the center sides of the cylinder heads; further reduce the lengths of the cylinder heads in the direction of the inlet and exhaust ports; hence further expand the space between the banks; and facilitate the operations such as the attachment or the detachment of the injectors without detaching the cylinder heads.

Furthermore, since each of the inlet ports has a lower inlet port disposed integrally with a cylinder head and an upper inlet port disposed not integrally with the cylinder head, it is possible to detach the upper inlet port from the cylinder head and facilitate the operations such as the attachment or the detachment of the injectors. In addition, since each of the upper inlet ports is attached to the lower inlet port in the manner of changing the angle to a direction closer to the head cover on the cylinder head, it is possible to expand the space between the banks and facilitate the operations such as the attachment or the detachment of the upper inlet ports.

With the present invention, since an inlet port has a lower inlet port disposed integrally with a cylinder head and an upper inlet port disposed not integrally with the cylinder head, it is possible to detach the upper inlet port from a cylinder head for example and hence operations such as the attachment or the detachment of a fuel injection device can be carried out even though a bank angle is narrow. As a result, it is possible to dispose the fuel injection device inside a V bank that is the most appropriate position. Further, since the upper inlet port extends in the manner of changing an angle to a direction closer to a head cover of the cylinder head, it is possible to expand space between the banks and the operations such as the attachment or the detachment of the upper inlet port are facilitated.

Since the upper inlet ports of the paired front and rear banks extend upward nearly parallel with each other and an inlet chamber disposed inside the V bank is connected to the top ends of the upper inlet ports, the top ends of the upper inlet ports connected to the inlet chamber are disposed at the upper part inside the V bank having a larger space and hence it is possible to easily dispose the inlet chamber. Further, by changing the lengths of the paired front and rear upper inlet ports from each other for example, it is possible to inhibit gaps and stress from occurring at the interface between the paired front and rear upper inlet ports and the inlet chamber.

Further, since the fuel injection device is disposed below the lower inlet port, the fuel injection device is disposed on the inlet port side in the manner of being laid down away from a cylinder axis, and hence ignitability or the like improves. Furthermore, since the fuel injection device is disposed along the lower inlet port, it is possible to inhibit the fuel injection device from protruding from the bank; and downsize the bank. As a result, it is possible to expand the space between the banks and the operations such as the attachment or the detachment of the fuel injection device are facilitated.

Since one of the upper inlet ports of the paired front and rear banks is formed of the elastic member, the elastic member is elastically deformed and hence it is possible to further absorb the difference in level and angle of the interface between the paired front and rear inlet ports and the inlet chamber. Accordingly, it is possible to further suppress the stress on the interface and also to improve sealability.

Since at least a part of one of the upper inlet ports of the paired front and rear banks is formed of the elastic member, it is possible to further absorb difference in level and angle of the interface between the paired front and rear inlet ports and the inlet chamber while ensuring necessary rigidity of the upper inlet port. Accordingly, it is possible to further suppress the stress on the interface between the paired front and rear upper inlet ports and the inlet chamber and also to improve sealability.

Since the upper inlet port is vertically divided into two and the elastic member is formed between the divided inlet ports, the elastic member is vertically elastically deformed and hence it is possible to easily adjust the vertical length of the upper inlet port. Accordingly, it is possible to further suppress the stress on the interface between the paired front and rear upper inlet ports and the inlet chamber and also to improve sealability.

Since the elastic member is formed by burning rubber on a surface of metal, the elastic member is integrated with the upper inlet port and hence it is possible to handle the upper inlet port as one component. Accordingly, the upper inlet port can be easily attached and detached.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments according to the present invention will be hereunder explained in reference to drawings. Here in the explanations, the terms "front, rear, right, left, top, and bottom" representing directions are based on a vehicle body.

Figure 1:
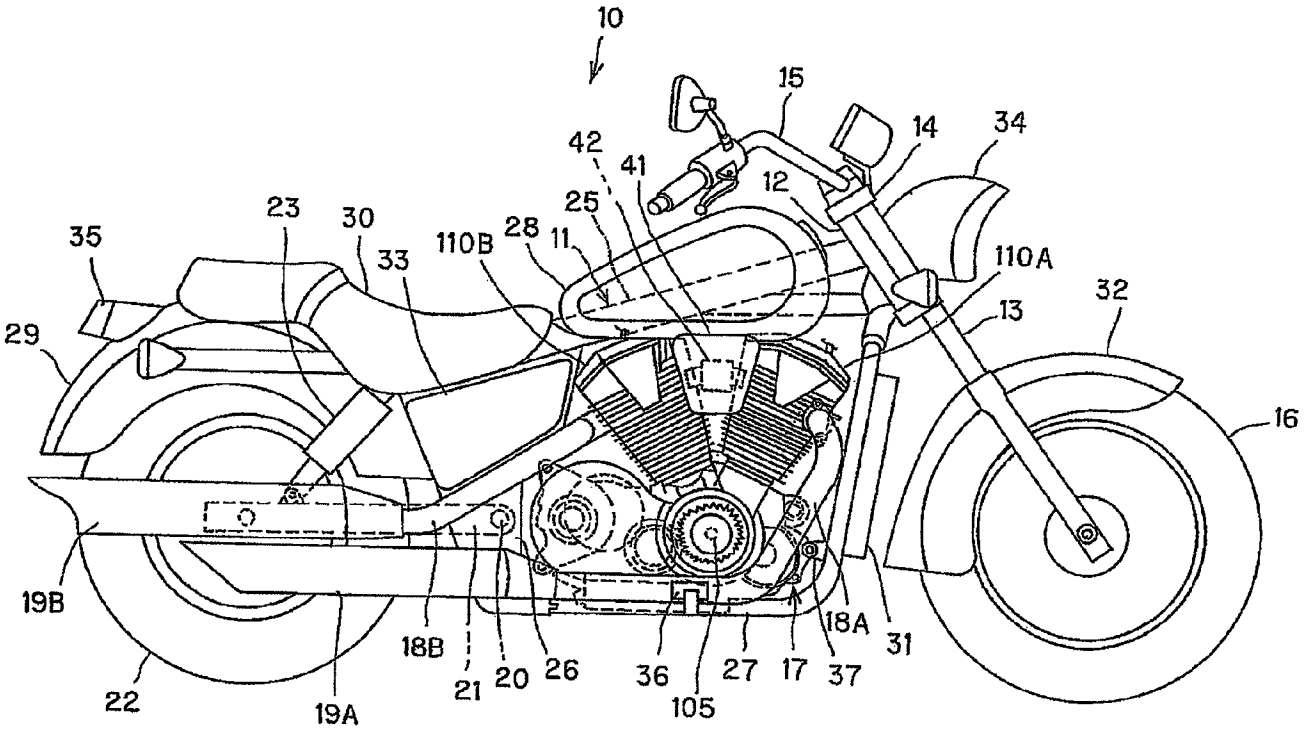
FIG. 1 is a side view showing a motorcycle on which an engine according to an embodiment of the present invention is mounted.

FIG. 1 is a side view showing a motorcycle to which an engine according to an embodiment of the present invention is applied. The motorcycle 10 has a body frame 11, a pair of right and left front forks 13 turnably supported by a head pipe 12 attached to a front end of the body frame 11, a steering handlebar 15 attached to a top bridge 14 to support top ends of the front forks 13, a front wheel 16 rotatably supported by the front forks 13, an engine 17 as a V-type internal combustion engine supported by the body frame 11, exhaust mufflers 19A and 19B connected to the engine 17 through exhaust pipes 18A and 18B, a rear swing arm 21 vertically swingably supported by a pivot 20 at a lower rear part of the body frame 11, a rear wheel 22 rotatably supported by a rear end of the rear swing arm 21, and a rear cushion 23 is disposed between the rear swing arm 21 and the body frame 11.

The body frame 11 has a main frame 25 extending from the head pipe 12 downward toward the rear, a pair of right and left pivot plates (also called center frames) 26 connected to the rear part of the main frame 25, and a down tube 27 extending downward from the head pipe 12, thereafter bending, then extending again, and being connected to the pivot plates 26. A fuel tank 28 is supported so as to straddle the main frame 25, the rear part of the main frame 25 extends above the rear wheel 22 and supports a rear fender 29, and a seat 30 is supported between above the rear fender 29 and the fuel tank 28. Here in FIG. 1, the reference numeral 31 represents a radiator supported by the down tube 27, 32 a front fender, 33 a side cover, 34 a headlight, 35 a taillight, and 36 a rider's step.

The engine 17 is supported at the space surrounded by the main frame 25, the pivot plates 26, and the down tube 27. The engine 17 is a two-cylinder water-cooled four-cycle engine of a V-type having cylinders banked in the shape of V in the anteroposterior direction. The engine 17 is supported by the body frame 11 through a plurality of engine brackets 37 (only a part thereof is shown in FIG. 1) so that the crankshaft 105 is directed in the horizontal direction lateral to the vehicle body. The power of the engine 17 is transmitted to the rear wheel 22 through a drive shaft (not shown) disposed on the left side of the rear wheel 22.

In the engine 17, a nip angle (also called a bank angle) formed by a front bank 110A and a rear bank 110B constituting cylinders respectively is formed so as to be smaller than 90 degrees (for example 52 degrees). Each of respective valve gears of the banks 110A and 110B is a double overhead camshaft (DOHC) type having four valves.

An air cleaner 41 and a throttle body 42 constituting an engine inlet system are disposed in the V-shaped space formed with the front bank 110A and the rear bank 110B. The throttle body 42 supplies air cleaned with the air cleaner 41 to the front bank 110A and the rear bank 110B. Further, the exhaust pipes 18A and 18B constituting an engine exhaust system are connected to the banks 110A and 110B respectively and the exhaust pipes 18A and 18B pass through the right side of the vehicle body and are connected to the exhaust mufflers 19A and 19B at the rear ends respectively. Then exhaust gas is exhausted through the exhaust pipes 18A and 18B and the exhaust mufflers 19A and 19B.

Figure 2:
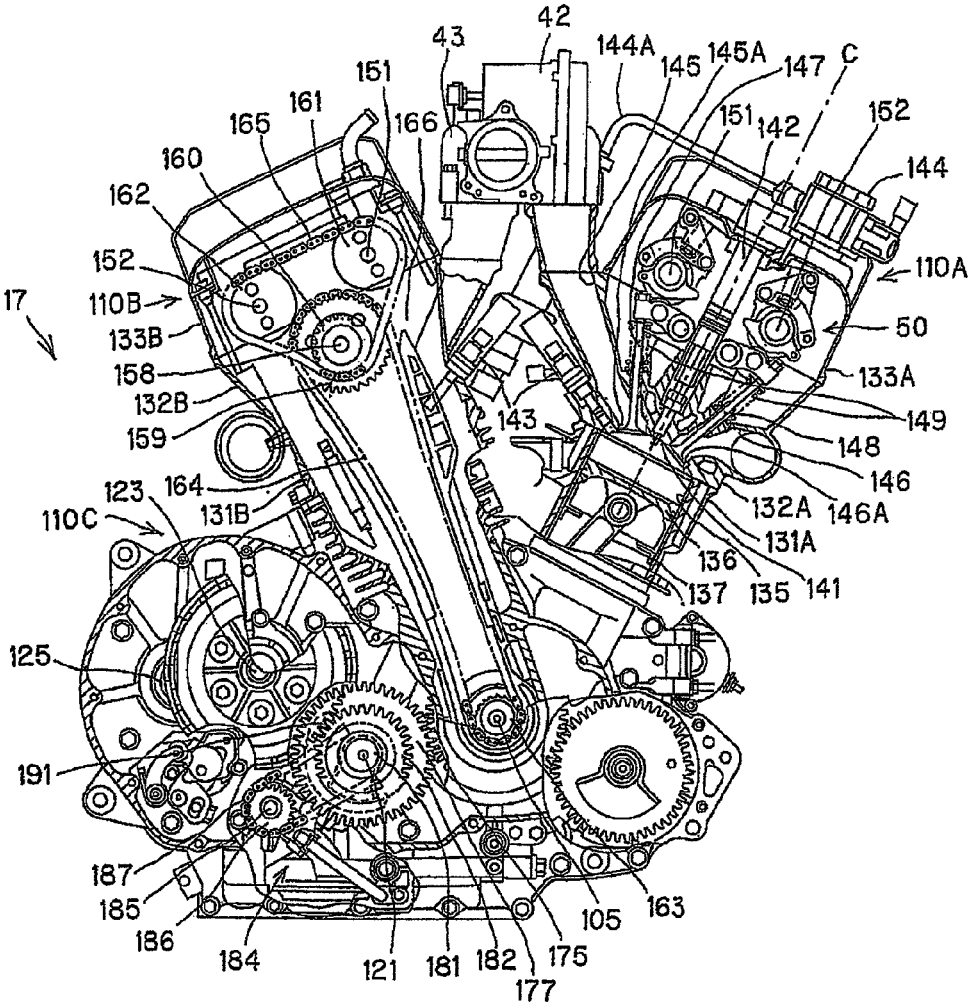
FIG. 2 is a side view showing the inner structure of the engine.
Figure 3:
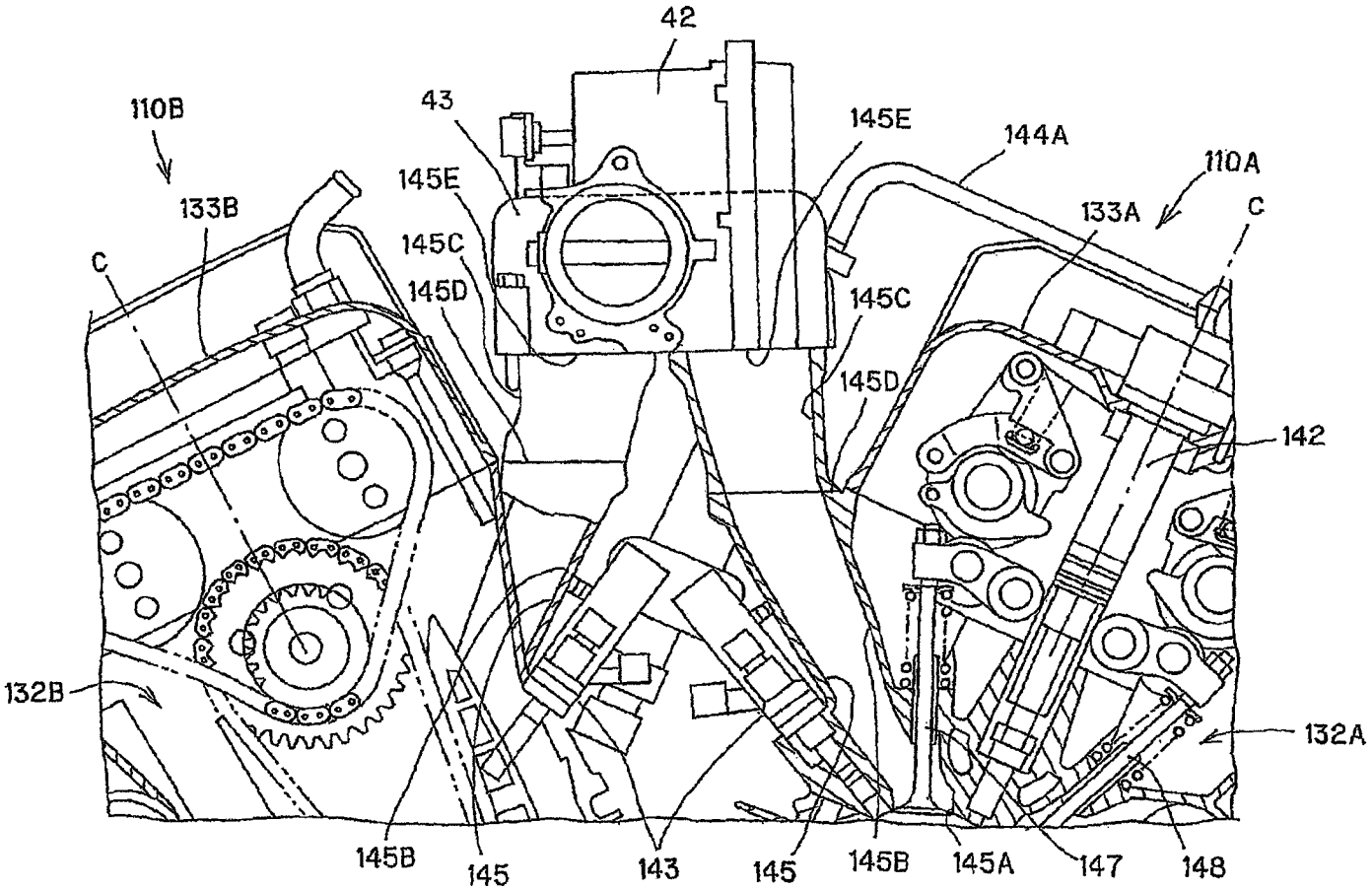
FIG. 3 is an enlarged side view showing an engine inlet system in FIG. 2.
Figure 4:
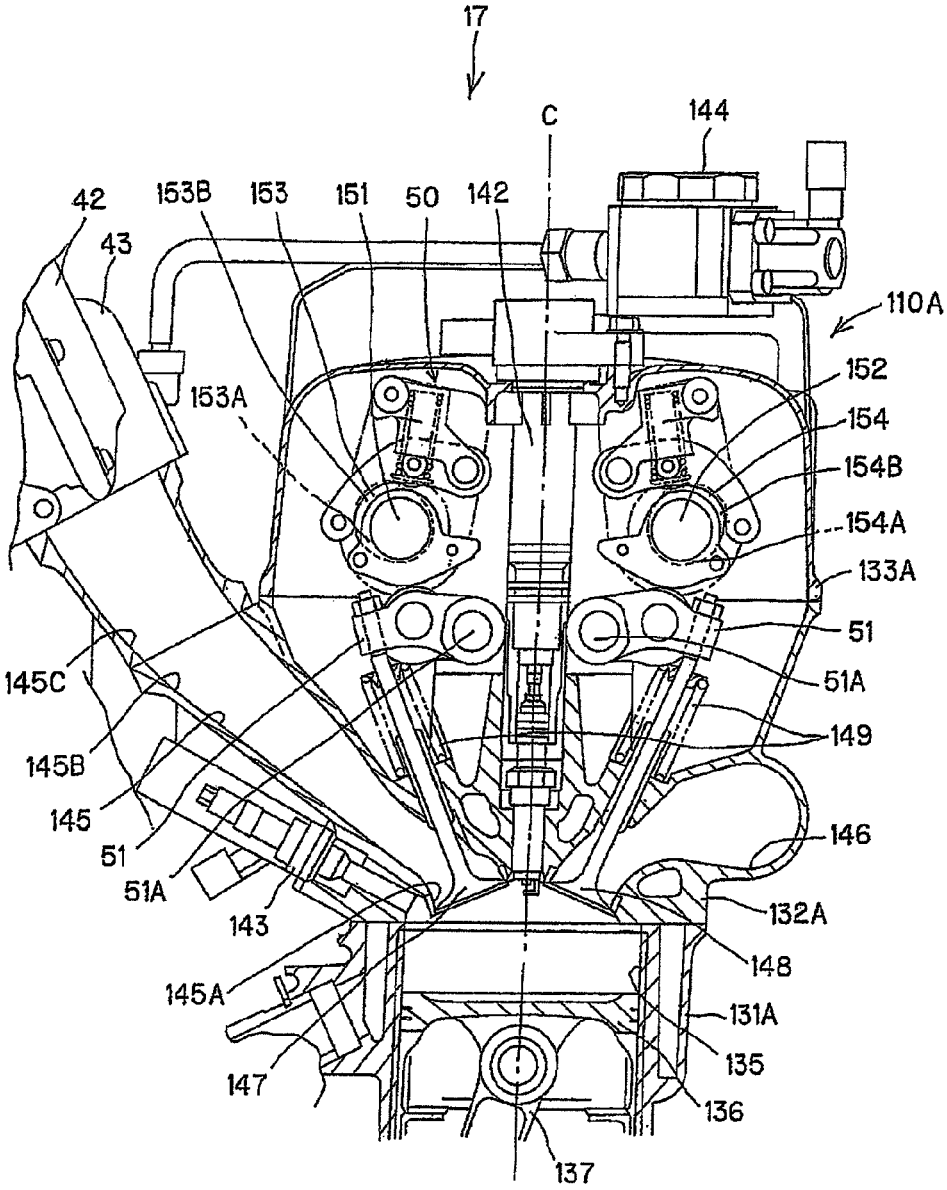
FIG. 4 is an enlarged side view showing the inner structure of a front bank in FIG. 2.

FIG. 2 is a side view showing the inner structure of the engine 17, FIG. 3 an enlarged side view showing an engine inlet system in FIG. 2, and FIG. 4 an enlarged view showing the inner structure of the front bank 110A in FIG. 2.

In FIG. 2, the front bank 110A and the rear bank 110B of the engine 17 have the same structure. In FIG. 2, the front bank 110A is shown as a view around a piston and the rear bank 110B is shown as a view around cam chains. Then in FIG. 2, the reference numeral 121 represents an intermediate shaft (a rear balancer shaft), 123 a main shaft, and 125 a countershaft. The shafts 121, 123, and 125 together with the crankshaft 105 are disposed parallel to each other in the manner of deviating from each other in the directions anteroposterior and vertical to the vehicle body and a gear transfer mechanism to sequentially transfer the rotation of the crankshaft 105 to the intermediate shaft 121, the main shaft 123, and the countershaft 125 is configured in a crankcase 110C to support those shafts.

As shown in FIG. 2, a front side cylinder block 131A and a rear side cylinder block 131B are disposed on the upper face of the crankcase 110C of the engine 17 in the manner of forming a prescribed nip angle in the anteroposterior direction of the vehicle body, a front side cylinder head 132A and a rear side cylinder head 132B are connected to the upper faces of the cylinder blocks 131A and 131 B respectively, further head covers 133A and 133B are attached to the upper faces of the cylinder heads 132A and 132B respectively, and thereby the front bank 110A and the rear bank 110B are constructed respectively.

Cylinder bores 135 (cylinders) are formed at the cylinder blocks 131A and 131B respectively, pistons 136 are slidably inserted into the cylinder bores 135 respectively, and the pistons 136 are connected to the crankshaft 105 through connecting rods 137 respectively. Since the two connecting rods 137 of the front and rear banks 110A and 110B are connected to the common crankshaft 105, the connecting rod 137 of the rear bank 110B is disposed adjacently on the vehicle body left side of the connecting rod 137 of the front bank 110A.

Combustion recesses 141 to constitute the ceilings of combustion chambers formed above the pistons 136 are formed on the bottom faces of the cylinder heads 132A and 132B respectively and ignition plugs 142 are disposed at the combustion recesses 141 in the manner of protruding the tips thereof respectively. The ignition plugs 142 are disposed nearly on the same axes as the cylinder axis lines C.

The engine 17 is a direct injection type engine to directly inject fuel into the combustion chambers from injectors 143 disposed at the combustion recesses 141 respectively. The injectors 143 are inserted from the side faces of the cylinder heads 132A and 132B inside the V bank and disposed so as to protrude the tips thereof into the combustion recesses 141 respectively. The injectors 143 are attached in the manner of being laid down away from the cylinder axis lines C.

A fuel pump 144 is disposed above the cylinder head 132A and fuel is supplied to the injectors 143 from the fuel pump 144 through a fuel pipe 144A.

At the cylinder heads 132A and 132B, inlet ports 145 (inlet pipes) communicating with the combustion recesses 141 through a pair of openings 145A and exhaust ports 146 communicating with the combustion recesses 141 through a pair of openings 146A are formed respectively. The inlet ports 145 are disposed between the cylinder axis lines C and the injectors 143 respectively. The inlet ports 145 of the front and rear banks 110A and 110B have a nearly identical inlet passage length.

As shown in FIGS. 2 and 3, the inlet ports 145 merge at an inlet chamber 43 and the inlet chamber 43 is connected to the throttle body 42. The exhaust port 146 of the cylinder head 132A is connected to the exhaust pipe 18A (refer to FIG. 1) and the exhaust port 146 of the cylinder head 132B is connected to the exhaust pipe 18B (refer to FIG. 1).

The inlet ports 145 have lower inlet ports 145B disposed integrally with the cylinder heads 132A and 132B and upper inlet ports 145C not integrated with the cylinder heads 132A and 132B and connected to the top ends 145D of the lower inlet ports 145B respectively as shown in FIG. 3. The upper inlet ports 145C are fixed to the lower inlet ports 145B with bolts not shown and extend in the manner of changing the angles to directions closer to the head covers 133A and 133B respectively. The injectors 143 are disposed below and along the lower inlet ports 145B.

As shown in FIGS. 2 and 4, the inlet ports 145 have lower inlet ports 145B disposed integrally with the cylinder heads 132A and 132B and upper inlet ports 145C disposed not integrally with the cylinder heads 132A and 132B respectively. By the configuration, the upper inlet ports 145C can be detached from the cylinder heads 132A and 132B and hence the operations such as the attachment or the detachment of the injectors 143 are facilitated. Further, the upper inlet ports 145C are fixed to the lower inlet ports 145B with bolts not shown and extend from the lower inlet ports 145B in the manner of changing the angles to directions closer to the head covers 133A and 133B. Since the upper inlet ports 145C are attached in the manner of changing the angles to directions closer to the head covers 133A and 133B in this way, it is possible to expand the space between the banks and facilitate the operations such as the attachment or the detachment of the upper inlet ports 145C.

The inlet ports 145 merge at an inlet chamber 43 and the inlet chamber 43 is connected to the throttle body 42. A TBW (Throttle By Wire) to change the cross-sectional area of a throttle valve by driving an actuator is adopted in the throttle body 42. The exhaust port 146 of the cylinder head 132A is connected to the exhaust pipe 18A (refer to FIG. 1) and the exhaust port 146 of the cylinder head 132B is connected to the exhaust pipe 18B (refer to FIG. 1).

The upper inlet ports 145C of the banks 110A and 110B extend upward nearly parallel with each other and an inlet chamber 43 disposed inside the V bank is connected to the top ends 145E (the top end openings) of the upper inlet ports 145C respectively. The inlet chamber 43 is also connected to the throttle body 42. As shown in FIG. 2, the exhaust port 146 of the cylinder head 132A is connected to the exhaust pipe 18A (refer to FIG. 1) and the exhaust port 146 of the cylinder head 132B is connected to the exhaust pipe 18B (refer to FIG. 1).

At the cylinder heads 132A and 132B, a pair of inlet valves 147 (engine valves) to open and close the openings 145A of the inlet ports 145 and a pair of exhaust valves 148 (engine valves) to open and close the openings 146A of the exhaust ports 146 are disposed. The inlet valves 147 and the exhaust valves 148 are urged in the direction of closing the ports with valve springs 149 and 149 respectively. The valve bodies 147 and 148 are driven by valve gears 50 (variable valve mechanisms) that can change the valve operating characteristics such as the timing of opening or closing, lift, and the like. The valve gears 50 are rotatably supported by the cylinder heads 132A and 132B and have camshafts 151 and 152 rotating in synchronization with the rotation of the engine 17 on the inlet side and the exhaust side respectively.

An inlet cam 153 (a drive cam) is formed integrally with each of the camshafts 151 as shown in FIG. 4. The inlet cam 153 has a round base section 153A to form a round cam face and a cam protruding section 153B to protrude outward from the round base section 153A and form a protruding cam face. Further, an exhaust cam 154 (a drive cam) is formed integrally with each of the camshafts 152. The exhaust cam 154 has a round base section 154A to form a round cam face and a cam protruding section 154B to protrude outward from the round base section 154A and form a protruding cam face.

As shown in FIG. 2, an intermediate shaft 158 is rotatably supported at an end of each of the cylinder heads 132A and 132B in the lateral direction and intermediate sprockets 159 and 160 are fixed to the intermediate shaft 158. A driven sprocket 161 is fixed to an end of each of the camshafts 151, a driven sprocket 162 is fixed to an end of each of the camshafts 152, and drive sprockets 163 are fixed to both the ends of the crankshaft 105. A first cam chain 164 is wound around the sprockets 159 and 163 and a second cam chain 165 is wound around the sprockets 160 to 162. The sprockets 159 to 163 and the cam chains 164 and 165 are contained in cam chain chambers 166 formed at ends of the banks 110A and 110B respectively.

The speed reduction ratio from the drive sprocket 163 to the driven sprockets 161 and 162 is set at 2 and, when the crankshaft 105 rotates, the drive sprocket 163 rotates integrally with the crankshaft 105, the driven sprockets 161 and 162 rotate at half the rotation speed of the crankshaft 105 through the cam chains 164 and 165, and the inlet valve 147 and the exhaust valve 148 open and close the inlet port 145 and the exhaust port 146 respectively in accordance with the cam profiles of the camshafts 151 and 152 rotating integrally with the driven sprockets 161 and 162.

A dynamo not shown is disposed at the left end of the crankshaft 105 and a drive gear (hereunder referred to as a crank side drive gear) 175 is fixed to the right end of the crankshaft 105 inside the drive sprocket 163 on the right side (the vehicle body left side). The crank side drive gear 175 engages with a driven gear (hereunder referred to as an intermediate side driven gear) 177 disposed at the intermediate shaft 121; transfers the rotation of the crankshaft 105 to the intermediate shaft 121 at constant speed; and rotates the intermediate shaft 121 at the same speed as the crankshaft 105 in the opposite direction from the crankshaft 105.

The intermediate shaft 121 is rotatably supported below and behind the crankshaft 105 and below and before the main shaft 123.

An oil pump drive sprocket 181, the intermediate side driven gear 177, and a drive gear (hereunder referred to as an intermediate side drive gear) 182 having a smaller diameter than the driven gear 177 are attached sequentially to the right end of the intermediate shaft 121.

The oil pump drive sprocket 181 transmits the torque of the intermediate shaft 121 to a driven sprocket 186 fixed to a drive shaft 185 of an oil pump 184 located on the rear side of the intermediate shaft 121 and disposed below the main shaft 123 through a driving chain 187; and drives the oil pump 184.

Further, the intermediate side drive gear 182 engages with a driven gear (hereunder referred to as a main side driven gear) 191 disposed relatively rotatably to the main shaft 123 and transmits the rotation of the intermediate shaft 121 to the main shaft 123 at a reduced speed through a clutch mechanism (not shown). That is, the speed reduction ratio from the crankshaft 105 to the main shaft 123, namely the first speed reduction ratio of the engine 17, is determined by the speed reduction ratio of the intermediate side drive gear 182 and the main side driven gear 191.

The main shaft 123 is rotatably supported above and behind the crankshaft 105 and the countershaft 125 is rotatably supported nearly behind the main shaft 123. A transmission gear group not shown is disposed in the manner of straddling the main shaft 123 and the countershaft 125 and a transmission comprises those units.

The left end of the countershaft 125 is connected to a drive shaft (not shown) extending in the anteroposterior direction of the vehicle body. By so doing, the rotation of the countershaft 125 is transferred to the drive shaft.

Figure 5:
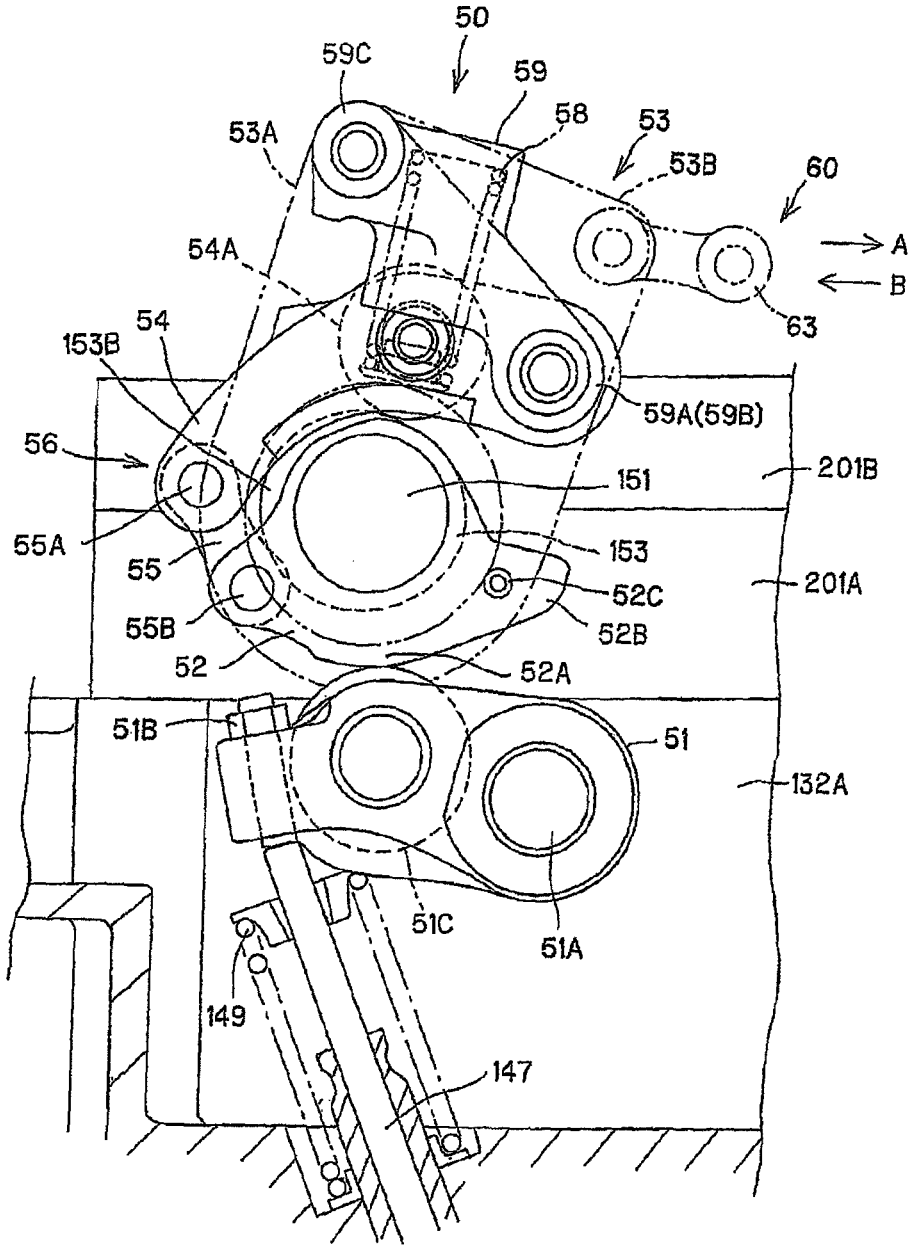
FIG. 5 is a side view showing a valve gear.
Figure 6A:
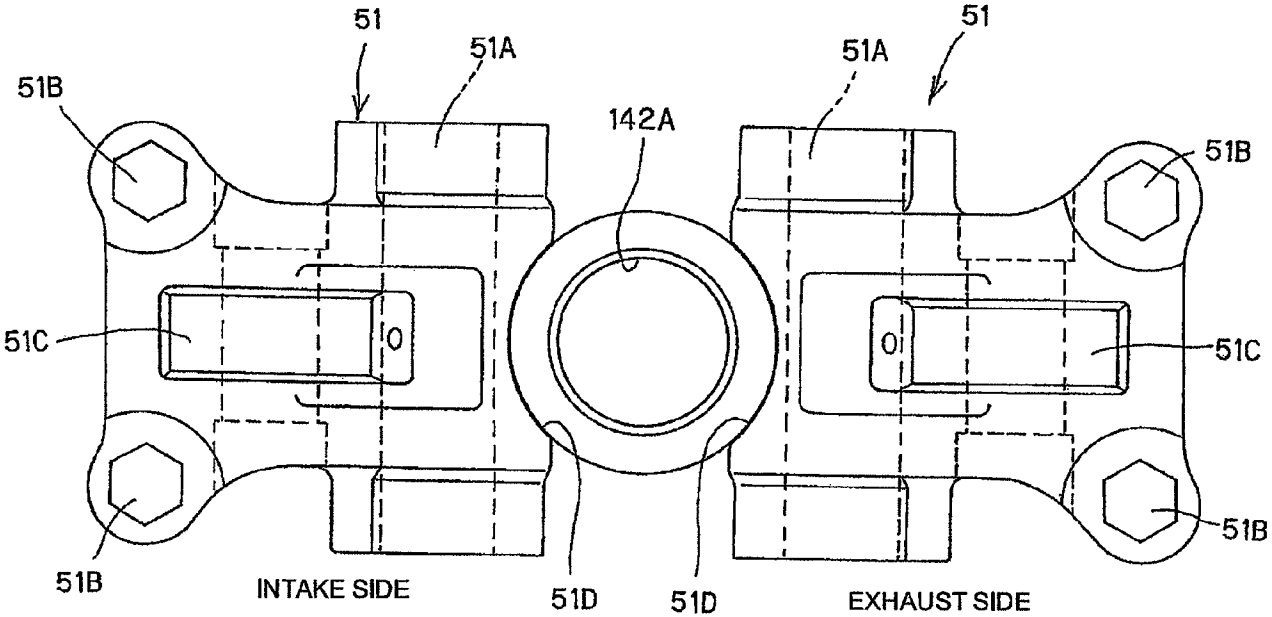
FIG. 6A is a plan view showing rocker arms.
Figure 6:
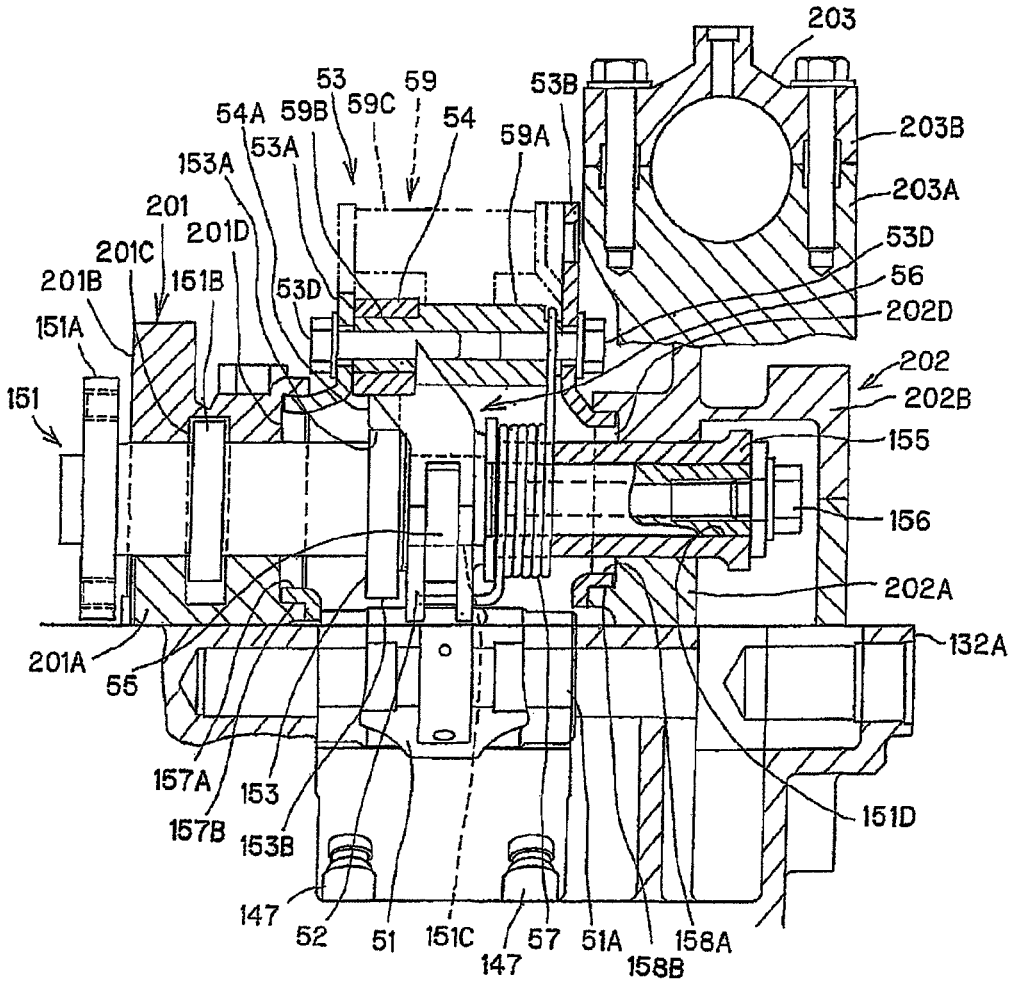
FIG. 6 is a vertical sectional view of the valve gear of the front bank viewed from the rear side.

FIG. 5 is a side view showing a valve gear 50 and FIG. 6 is a vertical sectional view of the valve gear 50 of the front bank 110A viewed from the rear side. FIG. 6A is a plan view showing rocker arms 51.

The valve gear 50 is disposed independently on both the inlet side and the exhaust side symmetrically about the cylinder axis line C as shown in FIG. 4. Since the valve gears 50 of the front bank 110A and the rear bank 110B are nearly identically configured, explanations are made on the basis of the valve gear 50 on the inlet side of the front bank 110A in the present embodiment.

The valve gear 50, as shown in FIGS. 5 and 6, has a camshaft 151 (a camshaft 152 on the exhaust side); an inlet cam 153 (an exhaust cam 154 on the exhaust side) rotating integrally with the camshaft 151; a rocker arm 51 to open and close an inlet valve 147 (an exhaust valve 148 on the exhaust side); a valve cam 52 to be supported relatively rotatably by the camshaft 151 and to open and close the inlet valve 147 through the rocker arm 51; a holder 53 (a holder member) swingable around the camshaft 151; a link mechanism 56 to be swingably supported by the holder 53, transfer the valve driving force of the inlet cam 153 to the valve cam 52, and swing the valve cam 52; and a drive mechanism 60 to swing the holder 53. Further, the link mechanism 56 has a sub-rocker arm 54 to be connected to the holder 53; and a connecting link 55 to swingably connect the sub-rocker arm 54 to the valve cam 52.

The locker arm 51 is formed in the manner of laterally extending and the paired inlet valves 147 are opened and closed with the single rocker arm 51. The rocker arm 51 is swingably supported by a rocker arm pivot 51A fixed to the cylinder head 132A at an end thereof. A pair of adjusting screws 51B abutting on the top ends of the inlet valves 147 are disposed at the other end of the rocker arm 51 respectively and a roller 51C touching the valve cam 52 is rotatably supported at the center thereof.

The rocker arm pivots 51A are, as shown in FIG. 4, disposed on the center (the cylinder axis line C) side of the cylinder head 132A adjacently to the ignition plug 142 in a side view. By so doing, it is possible to reduce the length of the cylinder head 132A in the direction of the inlet and exhaust ports 145 and 146; hence expand the space between the banks; and facilitate the operations such as the attachment or the detachment of the injector 143.

As shown in FIG. 6A, a notched section 51D notched in the shape of a circular arc is formed along the shape of a plug hole 142A for the ignition plug 142 (refer to FIG. 3) formed in the cylinder head 132A at an end of each of the rocker arms 51 on the center side. Consequently, it is possible to further move the rocker arm 51 toward the center (the cylinder axis line C) side of the cylinder head 132A and further reduce the length of the cylinder head 132A in the direction of the inlet and exhaust ports 145 and 146 as shown in FIG. 4.

As shown in FIG. 6, the camshaft 151 has a sprocket fixing section 151A to which a driven sprocket 161 (refer to FIG. 2) is fixed at an end thereof and, sequentially from the side of the sprocket fixing section 151A, a positioning section 151B protruding toward the outer circumference of the camshaft 151 and having a round shape in cross section, the inlet cam 153, a swingable cam support section 151C to swingably support the valve cam 52, and a collar joint 151D formed so as to have a smaller diameter than the swingable cam support section 151C are formed. A camshaft collar 155 functioning as the bearing of the camshaft 151 fits with the collar joint 151D and the camshaft collar 155 is pressed toward the side of the valve cam 52 with a fixing bolt 156 tightened on the other side of the camshaft 151.

The camshaft 151 is rotatably supported by camshaft supports 201 and 202 at both the ends. More specifically, the camshaft supports 201 and 202 are configured by fixing caps 201B and 202B each having a support section of a semicircular shape in cross section to head side support sections 201A and 202A formed at the upper part of the cylinder head 132A, respectively. A groove 201C formed in conformity with the shape of the positioning section 151B is formed at the camshaft support 201 disposed on the side of the positioning section 151B and the camshaft 151 is positioned in the axial direction by regulating the position of the positioning section 151B with the groove 201C.

Further, holder support sections 201D and 202D to support the holder 53 are disposed on the faces of the camshaft supports 201 and 202 on the side of the inlet cam 153, respectively.

The valve cam 52 is disposed at the swing cam support section 151C disposed at the intermediate portion of the camshaft 151. At the valve cam 52, as shown in FIG. 5, a round base section 52A to keep the inlet valve 147 in the closed state and a cam protruding section 52B to push down the inlet valve 147 and open the valve are formed and a through-hole 52C is formed at the cam protruding section 52B. To the through-hole 52C, an end of a valve cam return spring 57 (refer to FIG. 6) to urge the valve cam 52 in the direction of keeping the cam protruding section 52B away from the roller 51C of the rocker arm 51, namely in the direction of closing the inlet valve 147, is attached. The valve cam return spring 57 is wrapped around the camshaft 151 and the other end thereof is attached to the holder 53 as shown in FIG. 6.

The holder 53 has first and second plates 53A and 53B disposed at a prescribed interval in the axial direction of the camshaft 151 in the manner of interposing the inlet cam 153 and the valve cam 52; and a connecting member 59 to connect the first and second plates 53A and 53B in the axial direction of the camshaft 151. The first plate 53A is disposed at an end side of the camshaft 151 to which the driven sprocket 161 is fixed and the second plate 53B is disposed at the other end side of the camshaft 151.

Further, the connecting member 59 has a shaft section 59A parallel with the camshaft 151 and a sub-rocker arm support section 59B (a fulcrum) to which an end of the sub-rocker arm 54 is connected is formed at an end of the shaft section 59A on the side of the first plate 53A. The connecting member 59 is fixed to the first and second plates 53A and 53B with a pair of bolts 53D inserted into both the ends of the shaft section 59A from the outer face sides of the first and second plates 53A and 53B. Further, the connecting member 59 has a shaft section 59C parallel with the shaft section 59A and fixed to the first and second plates 53A and 53B with a pair of bolts (not shown) inserted into both the ends of the shaft section 59C from the outer face sides of the first and second plates 53A and 53B.

Further, the first and second plates 53A and 53B have shaft holes 157A and 158A through which the camshaft 151 passes respectively and the peripheries of the shaft holes 157A and 158A form annular protrusions 157B and 158B protruding toward the holder support sections 201D and 202D. The holder 53 is supported by fitting the protrusions 157B and 158B with the holder support sections 201D and 202D and is swingable around the camshaft 151.

The sub-rocker arm 54, together with the inlet cam 153 and the valve cam 52 is disposed between the first and second plates 53A and 53B; is rotatably supported by the sub-rocker arm support section 59B of the connecting member 59 at an end; and is swingable around the sub-rocker arm support section 59B. A roller 54A touching the inlet cam 153 is rotatably supported at the center of the sub-rocker arm 54. An end of a connecting link 55 is connected to the other end of the sub-rocker arm 54 through a pin 55A (refer to FIG. 5) to swingably support the connecting link 55 and the valve cam 52 is connected to the other end of the connecting link 55 through a pin 55B (refer to FIG. 5) to swingably support the valve cam 52.

Further, as shown in FIG. 5, the sub-rocker arm 54 is urged by a sub-rocker arm return spring 58 contained in the connecting member 59 and the roller 54A of the sub-rocker arm 54 is always pushed to the inlet cam 153. Here, the sub-rocker arm return spring 58 is a coil spring.

Next, movements are explained.

In a valve gear 50 configured as stated above, in reference to FIG. 5, when the camshaft 151 rotates, the sub-rocker arm 54 is pushed up and swings around the shaft section 59A through the roller 54A by the cam protruding section 153B of the inlet cam 153 rotating integrally with the camshaft 151, and thereby the valve cam 52 rotates around the camshaft 151 in a clockwise direction in FIG. 5 through the connecting link 55. Then the cam protruding section 52B, together with the rocker arm 51, pushes down the inlet valve 147 by the rotation of the valve cam 52 through the roller 51C and the inlet valve 147 opens. Further, in the state where the camshaft 151 rotates further and the round base section 153A of the inlet cam 153 abuts the roller 54A, the sub-rocker arm 54 is pushed down with the sub-rocker arm return spring 58, the valve cam 52 rotates in a counterclockwise direction in FIG. 5 with the valve cam return spring 57, and the round base section 52A abuts the roller 51C. By so doing, the inlet valve 147 is pushed up with the valve spring 149 (refer to FIG. 2) and is closed.

In the valve gear 50, as shown in FIG. 5, a connecting link member 63 is connected to the holder 53. When the connecting link member 63 moves in the direction indicated with the arrow A, the holder 53 swings around the shaft center of the inlet side camshaft 151 in a clockwise direction, and the sub-rocker arm support section 59B is displaced downward in drawing. In contrast, when the connecting link member 63 moves in the direction indicated with the arrow B, the holder 53 swings around the shaft center of the inlet side camshaft 151 in a counterclockwise direction and the sub-rocker arm support section 59B is displaced upward in drawing.

By so doing, the valve gear 50 is configured so as to be able to change the operating characteristics on opening and closing of the inlet valve 147 and the exhaust valve 148.

Figure 7:
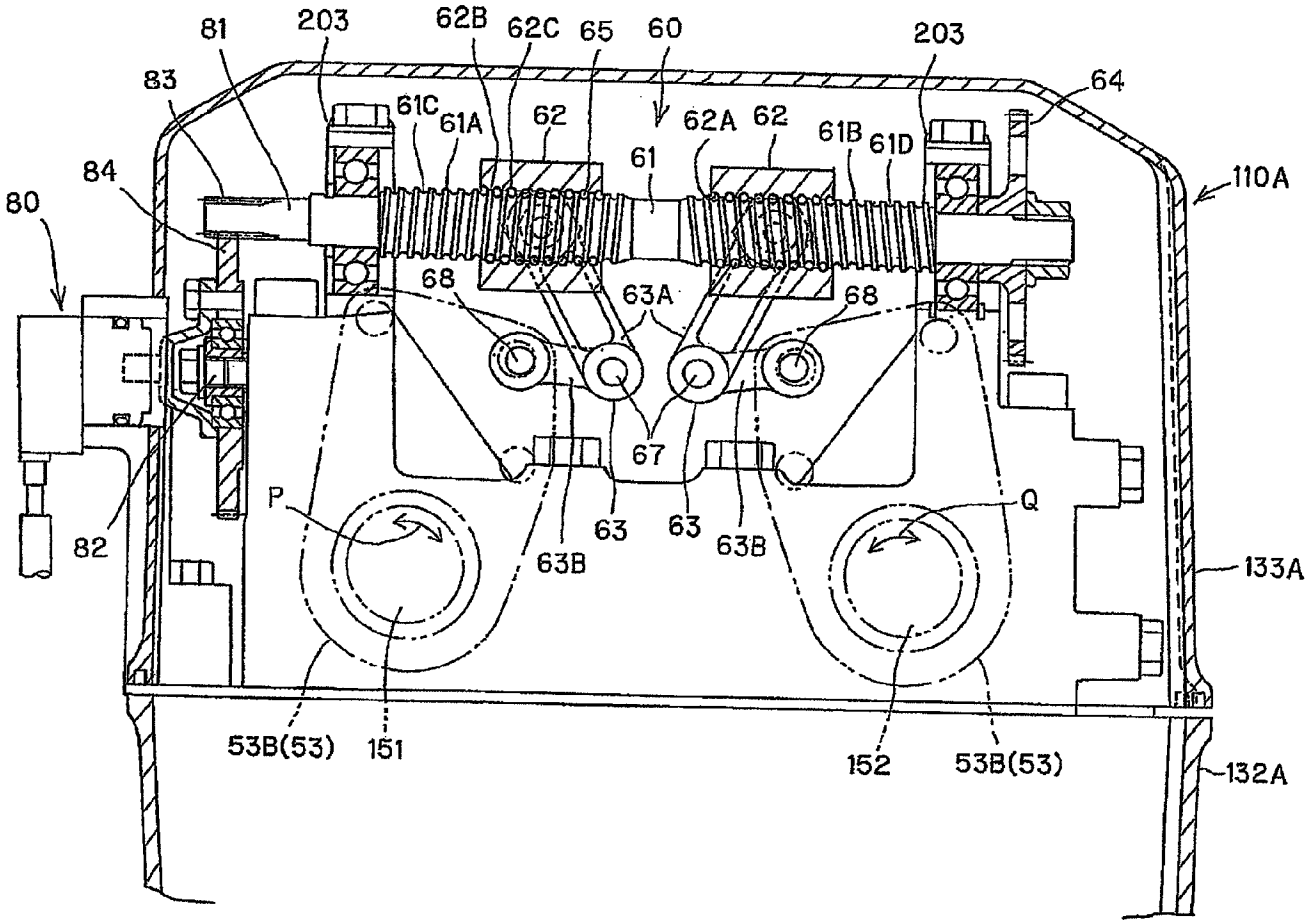
FIG. 7 is a vertical sectional view of a drive mechanism viewed from a side.

The connecting link member 63 is connected to a drive mechanism 60 as shown in FIG. 7.

Figure 8:
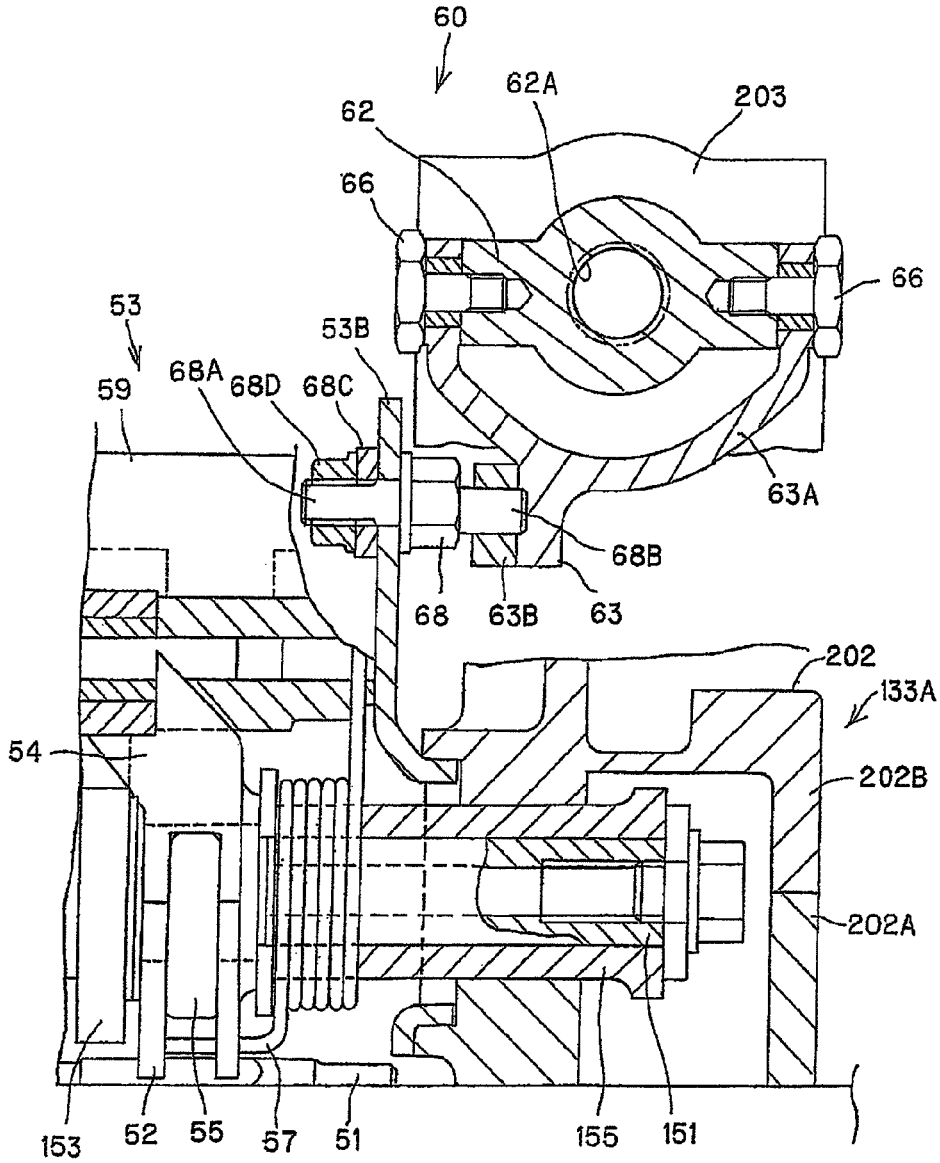
FIG. 8 is a vertical sectional view of a drive mechanism viewed from the front side.
Figure 9:
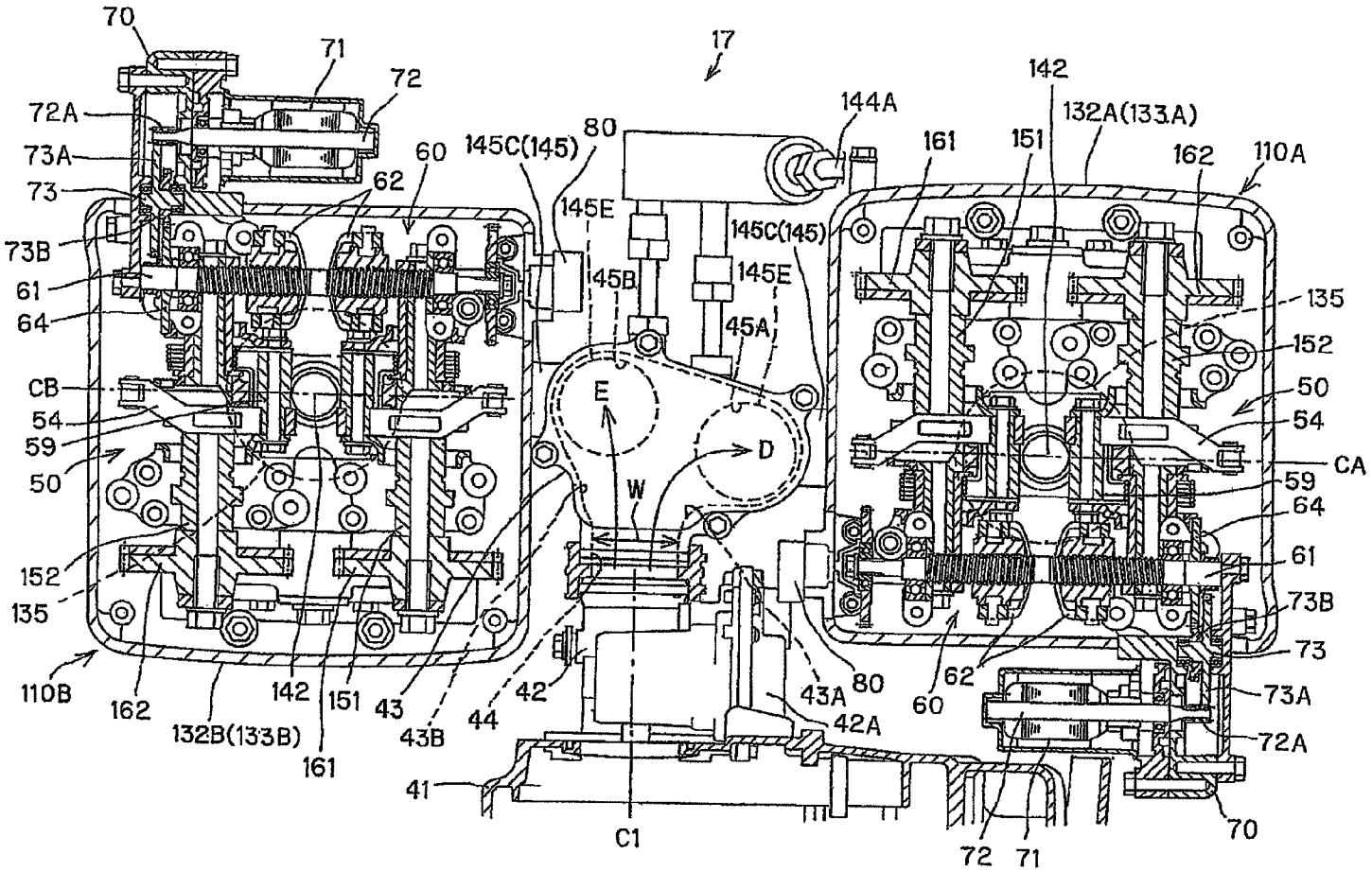
FIG. 9 is a transverse sectional view of the engine viewed from above.

FIG. 7 is a vertical sectional view of the drive mechanism 60 viewed from a side, and FIG. 8 is a vertical sectional view of the drive mechanism 60 viewed from the front side. FIG. 9 is a transverse sectional view of an engine 17 viewed from above. Here in FIG. 9, the front and rear banks 110A and 110B are shown as a view viewed from above the engine 17 along the cylinder axis line C (refer to FIG. 2).

The drive mechanism 60 is connected to the holders 53 through the connecting link members 63 as shown in FIG. 7. The drive mechanism 60 has a ball screw 61 disposed in the manner of straddling the inlet side camshaft 151 and the exhaust side camshaft 152 and two nuts 62 (sliders) that are disposed on the inlet side and the exhaust side respectively and are movable on the ball screw 61 in the axial direction, and the connecting link members 63 are disposed between the nuts 62 and the holders 53 respectively.

A driven gear 64 is fixed to an end of the ball screw 61 on the exhaust side and an electric actuator (an actuator) 70 (refer to FIG. 9) to rotate the ball screw 61 is connected to the driven gear 64 with gear rings. The electric actuator 70 has an electric motor 71, a drive shaft 72 (an axis line) of the electric motor 71, and an intermediate shaft 73 to which the driving force of the electric motor 71 is transferred from the drive shaft 72. The electric motor 71 is disposed so that the drive shaft 72 is nearly parallel with the top face of each of the head covers 133A and 133B.

A drive gear 72A is formed at the drive shaft 72, and a first intermediate gear 73A to engage with the drive gear 72A and a second intermediate gear 73B to engage with the gear 64 disposed at the ball screw 61 are fixed to the intermediate shaft 73.

Here, the paired front and rear banks 110A and 110B are disposed so as to be offset from each other in the axial direction of the camshafts 151 and 152 extending in the direction transverse to the vehicle body (in the vertical direction in FIG. 9). More specifically, the cylinder center line CA of the front bank 110A in the vehicle body anteroposterior direction is offset to the right of the vehicle body (in the downward direction in FIG. 9) and the cylinder center line CB of the rear bank 110B in the vehicle body anteroposterior direction is offset to the left of the vehicle body (in the upward direction in FIG. 9).

The ball screw 61 is perpendicular to the camshafts 151 and 152 and disposed on the other side of the camshafts 151 and 152, namely the side opposite the side to which the driven sprockets 161 and 162 (see FIG. 2) are fixed. In this way, since the ball screw 61 does not extend in the vertical direction of the engine 17 but is disposed in the manner of straddling the inlet side camshaft 151 and the exhaust side camshaft 152, it comes to be possible to reduce the height of the engine 17. The ball screw 61 is rotatably supported by ball screw support sections 203 at both the ends respectively. The ball screw support sections 203 are configured by fixing the caps 203B each having a support of a semicircular shape in cross section to the camshaft side support sections 203A formed at the upper section of the camshaft support 202 respectively as shown in FIG. 6.

As shown in FIG. 7, helical screw ridges 61A and 61B and helical shaft screw grooves 61C and 61D are formed on the inlet side and the exhaust side respectively on the outer circumference of the ball screw 61. The screw ridges 61A and 61B and the shaft screw grooves 61C and 61D are formed so that the winding direction on the inlet side is different from the winding direction on the exhaust side.

A sensor 80 to detect the rotation of the ball screw 61 is disposed at the other end of the ball screw 61 on the inlet side. The sensor 80 is fixed to the sidewall section of the head cover 133A (133B) located inside the V bank. Since the sensor 80 is disposed inside the V bank in this way, it is possible to reduce the length of the engine 17 in the vehicle body anteroposterior direction and also surround the sensor 80 with the front bank 110A and the rear bank 110B (refer to FIG. 2).

The sensor 80 has a rotary shaft 81 fixed to the other end of the ball screw 61; and a fixed shaft 82 being disposed below nearly parallel with the rotary shaft 81 and comprising a hexagonal screw fixed to the ball screw support section 203. A drive gear 83 is formed on the outer circumference of the rotary shaft 81 and a driven gear 84 engaging with the drive gear 83 is formed at the fixed shaft 82. Consequently, when the ball screw 61 rotates, the rotation of the rotary shaft 81 rotating integrally with the ball screw 61 is transferred to the driven gear 84 through the drive gear 83. The sensor 80 detects the number of rotation of the ball screw 61 from the number of the rotation of the driven gear 84.

Each of the nuts 62 has a through-hole 62A through which the ball screw 61 passes, and a helical nut screw ridge 62B corresponding to the screw ridges 61A and 61B and a helical nut screw groove 62C corresponding to the shaft screw grooves 61C and 61D are formed on the inner circumference of the through-hole 62A. A plurality of turnable balls 65 are disposed between the nut screw groove 62C and the shaft screw grooves 61C and 61D. The nuts 62 move on the ball screw 61 through the balls 65 when the ball screw 61 rotates.

Each of the connecting link members 63 has a nut side link 63A fixed to the nut 62 at an end thereof and a holder side link 63B connecting the other end of the nut side link 63A to the second plate 53B as shown in FIGS. 7 and 8.

An end of the nut side link 63A interposes the nut 62 from both the sides and is fixed to the nut 62 with bolts 66. The other end of the nut side link 63A is swingably supported by an end of the holder side link 63B with a pin 67. The other end of the holder side link 63B is swingably supported by the second plate 53B with an eccentric pin 68. The eccentric pin 68 has a hexagon head bolt 68A and an eccentric shaft 68B eccentrically formed integrally with the head section of the hexagon head bolt 68A. The hexagon head bolt 68A is fixed to the second plate 53B with a spring washer 68C and a hexagon nut 68D and the eccentric shaft 68B is rotatably supported by the nut side link 63A.

In FIG. 7, when the holders 53 swing in the directions indicated by the arrows P and Q, the position of the sub-rocker arm support section 59B of the link mechanism 56 shown in FIG. 5 is changed. When the position of the sub-rocker arm support section 59B is changed the valve cam 52 swings around the camshaft 151; the position is displaced in the circumferential direction of the camshaft 151; and the phase in the circumferential direction of the inlet cam 153, here the angle position or the position in the circumferential direction, is changed. By changing the position of the valve cam 52 in the circumferential direction of the inlet cam 153 in this way, the time span during which the cam ridge 52B of the valve cam 52 abuts the roller 51C and the stroke of pushing down can be changed and hence the time span of the opening and the lift of the inlet valve 147 can be changed.

For example, when the ball screw 61 rotates, the nuts 62 move toward the center side of the ball screw 61, and the holder 53 further swings in a clockwise direction in FIG. 5 with the connecting link member 63 the valve cam 52 rotates in a clockwise direction by the link mechanism 56; the camshaft 151 rotates in this state; then the time span during which the cam ridge 52B pushes down the roller 51C and the pushing down stroke increase; and the opening time span and the lift of the inlet valve 147 increase.

Next, an electric actuator 70 to make the time span of the opening and the lift of the inlet and exhaust valves 147 and 148 variable is explained.

FIG. 9 is a transverse sectional view of the engine 17 viewed from above. Here in FIG. 9, the engine 17 is shown as a view viewed from above along the cylinder axis lines C (refer to FIG. 2) of the front and rear banks 110A and 110B.

The anteroposteriorly paired (laterally paired in FIG. 9) front and rear banks 110A and 110B are disposed so as to be offset from each other in the axial direction of the camshafts 151 and 152 extending in the direction transverse to the vehicle body (in the vertical direction in FIG. 9). More specifically, the front bank 110A is offset to the left of the vehicle body (in the upward direction in FIG. 9) and the rear bank 110B is offset to the right of the vehicle body (in the downward direction in FIG. 9). The spaces corresponding to the offsets of the banks 110A and 110B are formed on the vehicle body right of the front bank 110A and on the vehicle body left of the rear bank 110B. By using the spaces, the electric actuators 70 are disposed on the side faces of the head covers 133A and 133B on the sides opposite to the directions of the offsets respectively. That is, the electric actuator 70 of the front bank 110A is disposed on the right side of the vehicle body (downside in FIG. 9) and the electric actuator 70 of the rear bank 110B is disposed on the left side of the vehicle body (upside in FIG. 9). The electric actuators 70 are attached so that the top faces are located lower than the top faces (not shown) of the head covers 133A and 133B respectively.

The electric actuators 70 are disposed at ends of the ball screws 61 on the exhaust sides and fixed to the sidewalls of the head covers 133A and 133B respectively. Each of the electric actuators 70 has an electric motor 71, a drive shaft 72 (an axis line) of the electric motor 71, and an intermediate shaft 73 to which the driving force of the electric motor 71 is transferred from the drive shaft 72. The electric motor 71 is disposed so that the drive shaft 72 is nearly parallel with the top face of each of the head covers 133A and 133B.

A drive gear 72A is formed at the drive shaft 72, and a first intermediate gear 73A to engage with the drive gear 72A and a second intermediate gear 73B to engage with the driven gear 64 disposed at the ball screw 61 are fixed to the intermediate shaft 73.

Each of the electric actuators 70 is controlled by an ECU (not shown) as an electronic control unit and drives the drive mechanism 60 in accordance with the operating conditions such as the number of rotation and the load of the engine 17 and the number of revolution of the ball screw 61, namely the number of revolution of the electric motor 71, input from the sensor 80. When the electric actuator 70 is driven, the driving force of the electric motor 71 is transferred to the ball screw 61 through the drive gear 72A, the first intermediate gear 73A, the second intermediate gear 73B, and the driven gear 64.

Next, the inlet chamber 43 and the neighboring parts are explained.

The cylinder bores 135 of the front and rear banks 110A and 110B are disposed so as to be offset from each other in the axial direction of the crankshaft 105 (refer to FIG. 2), namely in the axial direction of the camshafts 151 and 152, in proportion to the offset of the connecting rods 137 (refer to FIG. 2) in the transverse direction of the vehicle body. More specifically, the cylinder center line CA of the front bank 110A in the vehicle body anteroposterior direction is offset to the right of the vehicle body and the cylinder center line CB of the rear bank 110B in the vehicle body anteroposterior direction is offset to the left of the vehicle body.

The throttle body 42 is disposed on the right side of the vehicle body (downside in FIG. 9) inside the V bank. Since the cylinder bores 135 of the front and rear banks 110A and 110B are offset from each other in the transverse direction of the vehicle body, the cylinder bore 135 of the front bank 110A is closer to the throttle body 42 than the cylinder bore 135 of the rear bank 110B. The throttle body 42 is disposed in the manner of offsetting the center line C1 extending in the transverse direction of the vehicle body to the side of the cylinder bore 135 of the rear bank 110*b* away from the throttle body 42, namely to the rear side of the vehicle body (to the left side in FIG. 9). A space corresponding to the offset of the throttle body 42 is formed on the vehicle body front side of the throttle body 42 (the right side in FIG. 9).

A TBW (Throttle By Wire) to change the degree of the opening of the throttle by driving an actuator 42A is adopted in the throttle body 42. The actuator 42A is disposed on the side opposite to the direction of the offset of the throttle body 42, namely on the front side of the vehicle body in the V bank, by using the space formed by the offset of the throttle body 42.

The inlet chamber 43 functions as a settling tank to suppress inlet pulsation by expanding the cross section of the inlet passage larger than those of the inlet passages of the inlet ports 145 and the throttle body 42. The inlet chamber 43 is formed into the shape of a tank and has a nearly round connecting port 44 to be connected to the throttle body 42 on the right side of the vehicle body. The connecting port 44 is disposed in the manner of being offset to the side of the cylinder bore 135 of the rear bank 110*b* away from the throttle body 42, namely to the rear side of the vehicle body. A pair of nearly round through-holes 45A and 45B are formed at the bottom of the inlet chamber 43 and the top ends 145E of the upper inlet ports 145C are connected to the through-holes 45A and 45B respectively. An inlet passage 43A through which intake air flows from the connecting port 44 to the through-hole 45A along the arrow D and an inlet passage 43B through which intake air flows from the connecting port 44 to the through-hole 45B along the arrow E are formed in the inlet chamber 43.

The through-hole 45A is disposed so that the center is located on the cylinder center line CA of the front bank 110A and on the vehicle body front side from the connecting port 44. Consequently, the inlet path 43A is formed in the manner of bending from the connecting port 44 toward the vehicle body front. Meanwhile, the through-hole 45B is disposed so that the center is located on the cylinder center line CB of the rear bank 110B and in the range W of the connecting port 44 in the anteroposterior direction of the vehicle body. Consequently, the inlet path 43B is formed so as to be nearly straight from the connecting port 44 to the left of the vehicle body.

The inlet paths 43A and 43B have nearly identical length. Consequently, the offset of the throttle body 42 is set so that the inlet paths 43A and 43B take an identical length.

In this way, since the inlet passage 43A from the throttle body 42 to the top end 145E of the inlet port 145 leading to the cylinder bore 135 of the front bank 110A on the side close to the throttle body 42 is formed curvedly, the inlet passage 43B from the throttle body 42 to the top end 145E of the inlet port 145 leading to the cylinder bore 135 of the rear bank 110B on the side away from the throttle body 42 is formed nearly straight, and the throttle body 42 is offset to the side of the cylinder bore 135 of the rear bank 110B away from the throttle body 42, it is possible to equalize the lengths of the inlet passages 43A and 43B. As a result, the performance of the cylinder bores 135 is equalized and the performance of the engine 17 improves.

Since the throttle body 42 is disposed in the space expanded in the transverse direction of the vehicle body by the offset of the front and rear banks 110A and 110B inside the V bank, the attaching operation of the throttle body 42 is facilitated. Since the actuator 42A of the throttle body 42 is disposed in a wide space between the throttle body 42 and the front bank 110A formed by the offset of the throttle body 42, the attaching operation of the actuator 42A is facilitated.

As explained above, in the present embodiment, since the front and rear banks 110A and 110B have the inlet ports 145 having a nearly identical inlet passage length, the inlet chamber 43 is connected to the top ends 145E of the inlet ports 145, the throttle body 42 and the inlet chamber 43 are offset on the side leading to the cylinder bore 135 on the side away from the throttle body 42, the inlet chamber 43 is formed with, in its inside the nearly straight inlet passage 43B from the throttle body 42 to the top end 145E of the inlet port 145 leading to the cylinder bore 135 on the side away from the throttle body 42, and the curved inlet passage 43A to the top end 145E of the inlet port 145 leading to the cylinder bore 135 on the close side, it is possible to equalize the lengths of the inlet passages of the front and rear banks 110A and 110B; and as a result equalize the performance of the cylinder bores 135 and improve the performance of the engine 17.

Further, in the present embodiment, since the throttle body 42 has the actuator 42A to control the degree of the opening of the throttle on the side opposite to the direction of the offset, the actuator 42A is disposed in a wide space formed by the offset and hence the attaching operation of the actuator 42A is facilitated.

As explained above, in the present embodiment camshafts 151 and 152 are disposed independently for inlet and exhaust in the cylinder heads 132A and 132B on the cylinder blocks 131A and 131B respectively; rocker arms 51 to drive inlet and exhaust valves 147 and 148 by the driving force transferred from the camshafts 151 and 152 are disposed; and rocker arm pivots 51A of the rocker arms 51 are disposed on the center sides of the cylinder heads 132A and 132B. By so doing, even when output is increased as a four-valve engine for example, it is possible to move the rocker arms 51 toward the center sides of the cylinder heads 132A and 132B and reduce the lengths of the cylinder heads 132A and 132B in the direction of the inlet and exhaust ports 145 and 146 and hence it is possible to expand the space between the banks and dispose the injectors 143 while inlet passages are secured inside the V bank.

Further in the present embodiment, the ends of the rocker arms 51 on the center sides are notched along the shape of the plug hole 142A for the ignition plug 142. By so doing, it is possible to further move the rocker arms 51 toward the center sides of the cylinder heads 132A and 132B and further reduce the lengths of the cylinder heads 132A and 132B in the direction of the inlet and exhaust ports 145 and 146 and hence it is possible to further expand the space between the banks and facilitate the operations such as the attachment or the detachment of the injectors 143 without detaching the cylinder heads 132A and 132B.

Furthermore in the present embodiment, the inlet ports 145 have lower inlet ports 145B disposed integrally with the cylinder heads 132A and 132B and upper inlet ports 145C disposed not integrally with the cylinder heads 132A and 132B respectively and hence it is possible to detach the upper inlet ports 145C from the cylinder heads 132A and 132B and facilitate the operations such as the attachment or the detachment of the injectors 143. In addition, the upper inlet ports 145C are attached to the lower inlet ports 145B in the manner of changing the angles to directions closer to the head covers 133A and 133B on the cylinder heads 132A and 132B and hence it is possible to expand the space between the banks and facilitate the operations such as the attachment or the detachment of the upper inlet ports 145C.

Next, the inlet ports 145 and the neighboring parts are explained. The neighbors of the inlet ports 145 are obviously shown in FIGS. 3, 9, and 10.

The inlet ports 145 have the lower inlet ports 145B disposed integrally with the cylinder heads 132A and 132B and the upper inlet ports 145C connected to the top ends 145D of the lower inlet ports 145B in the manner of not being integrated with the cylinder heads 132A and 132B respectively as shown in FIG. 3. The upper inlet ports 145C are fixed to the lower inlet ports 145B with bolts not shown and extend in the manner of changing the angles to directions closer to the head covers 133A and 133B. The injectors 143 are disposed below and along the lower inlet ports 145B.

The upper inlet ports 145C of the banks 110A and 110B extend upward nearly parallel with each other and the inlet chamber 43 disposed inside the V bank is connected to the top ends 145E of the upper inlet ports 145C. The inlet chamber 43 has the function as a settling tank to suppress inlet pulsation by expanding the cross section of the inlet path larger than those of the inlet paths of the inlet ports 145 and the throttle body 42.

The throttle body 42 is disposed inside the V bank on the right side of the vehicle body in the manner of offsetting the center line C1 extending in the transverse direction of the vehicle body to the side of the cylinder bore 135 of the rear bank 110*b* far from the throttle body 42, namely to the rear side of the vehicle body (to the left side in FIG. 9) as shown in FIG. 9. A TBW (Throttle By Wire) to change the degree of opening of the throttle by driving an actuator 42A is adopted in the throttle body 42.

The inlet chamber 43 is formed into the shape of a tank and has a nearly round connecting port 44 to be connected to the throttle body 42 on the right side of the vehicle body.

A pair of nearly round through-holes 45A and 45B are formed at the bottom of the inlet chamber 43 and the top ends 145E of the upper inlet ports 145C are connected to the through-holes 45A and 45B respectively. An inlet path 43A through which intake air flows from the connecting port 44 to the through-hole 45A along the arrow D and an inlet path 43B through which intake air flows from the connecting port 44 to the through-hole 45B along the arrow E are formed in the inlet chamber 43.

The through-hole 45A is disposed so that the center is located on the cylinder center line CA of the front bank 110A and on the vehicle body front side from the connecting port 44. Consequently, the inlet path 43A is formed in the manner of bending from the connecting port 44 toward the vehicle body front. Meanwhile, the through-hole 45B is disposed so that the center is located on the cylinder center line CB of the rear bank 110B and in the range W of the connecting port 44 in the anteroposterior direction of the vehicle body. Consequently, the inlet path 43B is formed so as to be nearly straight from the connecting port 44 to the left of the vehicle body. The inlet paths 43A and 43B have nearly identical length. Consequently, the offset of the throttle body 42 is set so that the inlet paths 43A and 43B take an identical length.

Next, a fuel supply system is explained.

Figure 10:
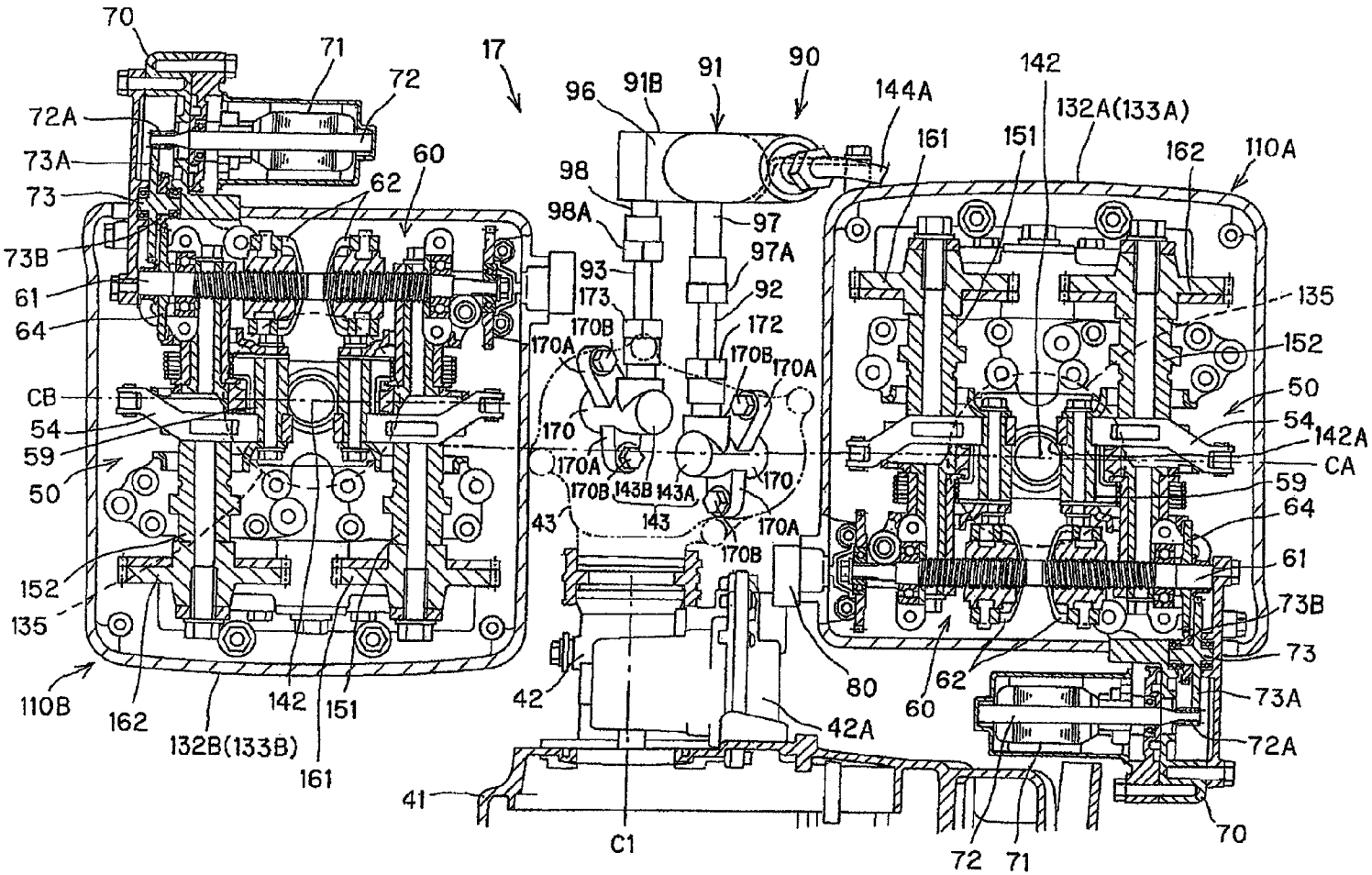
FIG. 10 is a transverse sectional view of the engine viewed from above.

A fuel supply system 90 has a fuel pump 144 (FIG. 2), a fuel pipe 144A, a fuel chamber 91 connected to the end of the fuel pipe 144A on the downstream side, fuel pipes 92 and 93 connecting the fuel chamber 91 to an injector 143, and the injector 143 as shown in FIG. 10. Further, the fuel chamber 91, the fuel pipes 92 and 93, and the injector 143 are disposed inside the V bank between the front bank 110A and the rear bank 110B.

A branch section 96 communicating with an accumulator and protruding in the anteroposterior direction is disposed at a bottom end section 91B of the fuel chamber 91.

A front side attaching section 97 to which the fuel pipe 92 is connected and a rear side attaching section 98 to which the fuel pipe 93 is connected are disposed on the plane of the branch section 96 facing the interior of the V bank, and the fuel in the accumulator is branched at the branch section 96 and flows toward downstream. Here, the fuel pipe 92 is the pipe connected to the injector 143A attached to the cylinder head 132A and the fuel pipe 93 is the pipe connected to the injector 143B attached to the cylinder head 132B.

The front side attaching section 97 and the rear side attaching section 98 are formed into the shape of pipes protruding toward the sides of the injectors 143A and 143B and attaching nut sections 97A and 98A are disposed at the ends. Further, the front side attaching section 97 and the rear side attaching section 98 are formed with a space between them in the anteroposterior direction of the vehicle body and extend parallel with each other nearly horizontally. Then the fuel pipes 92 and 93 are easily attached and detached by rotating the attaching nut sections 97A and 98A with a tool or the like in the state of being inserted into the attaching nut sections 97A and 98A, respectively.

The injectors 143A and 143B are located at intermediate positions in the width direction inside the V bank under the inlet chamber 43; and, in the vehicle width direction, disposed at the positions identical to the plug holes 142A where the ignition plugs 142 (refer to FIG. 2) are disposed. Each of the injectors 143A and 143B has fixing sections 170A protruding in two circumferential directions from the outer circumference of each of columnar injector main bodies 170 respectively. Then the injectors 143A and 143B are inserted into injector inserting sections (not shown) formed below the lower inlet ports 145B (refer to FIG. 3) and fixed to the cylinder heads 132A and 132B with a plurality of injector fixing bolts 170B passing through the fixing sections 170A, respectively.

Injector side attaching nut sections 172 and 173 protruding on the side of the fuel chamber 91 are disposed at the upper sections of the injectors 143A and 143B respectively.

The injector side attaching nut sections 172 and 173 are the connectors to which the fuel pipes 92 and 93 are connected respectively. The fuel pipes 92 and 93 are attached and detached by rotating the injector side attaching nut sections 172 and 173 in the state of being inserted into the injector side attaching nut sections 172 and 173.

Next, functions of the engine 17 are explained.

Since the inlet ports 145 have the lower inlet ports 145B disposed integrally with the cylinder heads 132A and 132B and the upper inlet ports 145C disposed not integrally with the cylinder heads 132A and 132B, it is possible to detach the upper inlet ports 145C from the cylinder heads 132A and 132B; and attach and detach the injectors 143. As a result, it comes to be possible to dispose the injectors 143 inside the V bank even though the bank angle is narrow. Further, since the upper inlet ports 145C is attached in the manner of changing the angles to directions closer to the head covers 133A and 133B, the space between the banks can be expanded and the attaching and detaching operations of the upper inlet ports 145C can be facilitated.

Since the injectors 143 are disposed at the lower parts of the lower inlet ports 145B, the injectors 143 are disposed on the inlet port 145 sides in the manner of being laid down away from the cylinder axis lines C and resultantly the ignitability of the engine 17 and the like improve. Further, since the injectors 143 are disposed along the lower inlet ports 145B, it is possible to prevent the injectors 143 from protruding from the banks 110A and 110B; and downsize the banks 110A and 110B. As a result, the space between the banks can be expanded and the attaching and detaching operations of the injectors 143 can be facilitated.

In some cases, production errors, assembly errors, and other errors of parts may occur at the lower inlet ports 145B formed at the cylinder heads 132A and 132B and the paired front and rear lower inlet ports 145B may hardly be connected to the inlet chamber 43.

In the present embodiment, since the inlet ports 145 have the upper inlet ports 145C not integrated with the cylinder heads 132A and 132B respectively, by changing the lengths of the paired front and rear upper inlet ports 145C from each other and using the upper inlet ports 145C having appropriate lengths conforming to the errors, it is possible to inhibit gaps and stress from occurring at the interface between the paired front and rear upper inlet ports 145C and the inlet chamber 43.

Since the paired front and rear upper inlet ports 145C extend upward nearly parallel with each other, the top ends 145E of the upper inlet ports 145C are located at the inside upper portion of the V bank having a larger space in comparison with the case where the paired front and rear upper inlet ports extend from the lower inlet ports so as to be perpendicular to each other without changing the angles. As a result, it is possible to easily dispose the inlet chamber 43 having a larger volume than the paired front and rear inlet ports 145 even though the bank angle is narrow.

As explained above, in the present embodiment, the inlet ports 145 have the lower inlet ports 145B integrated with the cylinder heads 132A and 132B and the upper inlet ports 145C not integrated with the cylinder heads 132A and 132B and connected to the top ends 145D of the lower inlet ports 145B. Consequently, the upper inlet ports 145C can be detached from the cylinder heads 132A and 132B, hence the injectors 143 can be attached and detached even though the bank angle is narrow, and as a result the injectors 143 can be disposed inside the V bank that is the most appropriate position. Further, since the upper inlet ports 145C extend in the manner of changing the angles to directions closer to the head covers 133A and 133B of the cylinder heads 132A and 132B, the space between the banks can be expanded and the attaching and detaching operations of the upper inlet ports 145C can be facilitated.

Further, in the present embodiment, the upper inlet ports 145C of the paired front and rear banks 110A and 110B extend upward nearly parallel with each other and the inlet chamber 43 disposed inside the V bank is connected to the top ends 145E of the upper inlet ports 145C. By so doing, since the top ends 145E of the upper inlet ports 145C to which the inlet chamber 43 is connected are located at the inside upper portion of the V bank having a larger space, it is possible to easily dispose the inlet chamber 43 even though the bank angle is narrow. Further, by changing the lengths of the paired front and rear upper inlet ports 145C from each other, it is possible to inhibit gaps and stress from occurring at the interface between the paired front and rear upper inlet ports 145C and the inlet chamber 43.

Further, in the present embodiment, since the injectors 143 are disposed at the lower parts of the lower inlet ports 145B and thus the injectors 143 are disposed on the side of the inlet ports 145 in the state of being laid down away from the cylinder axis lines C, ignitability or the like improves. Furthermore, since the injectors 143 are disposed along the lower inlet ports 145B, it is possible to inhibit the injectors 143 from protruding from the banks 110A and 110B; and downsize the banks 110A and 110B. As a result, the space between the banks can be expanded and the attaching and detaching operations of the injectors 143 can be facilitated.

Figure 11:
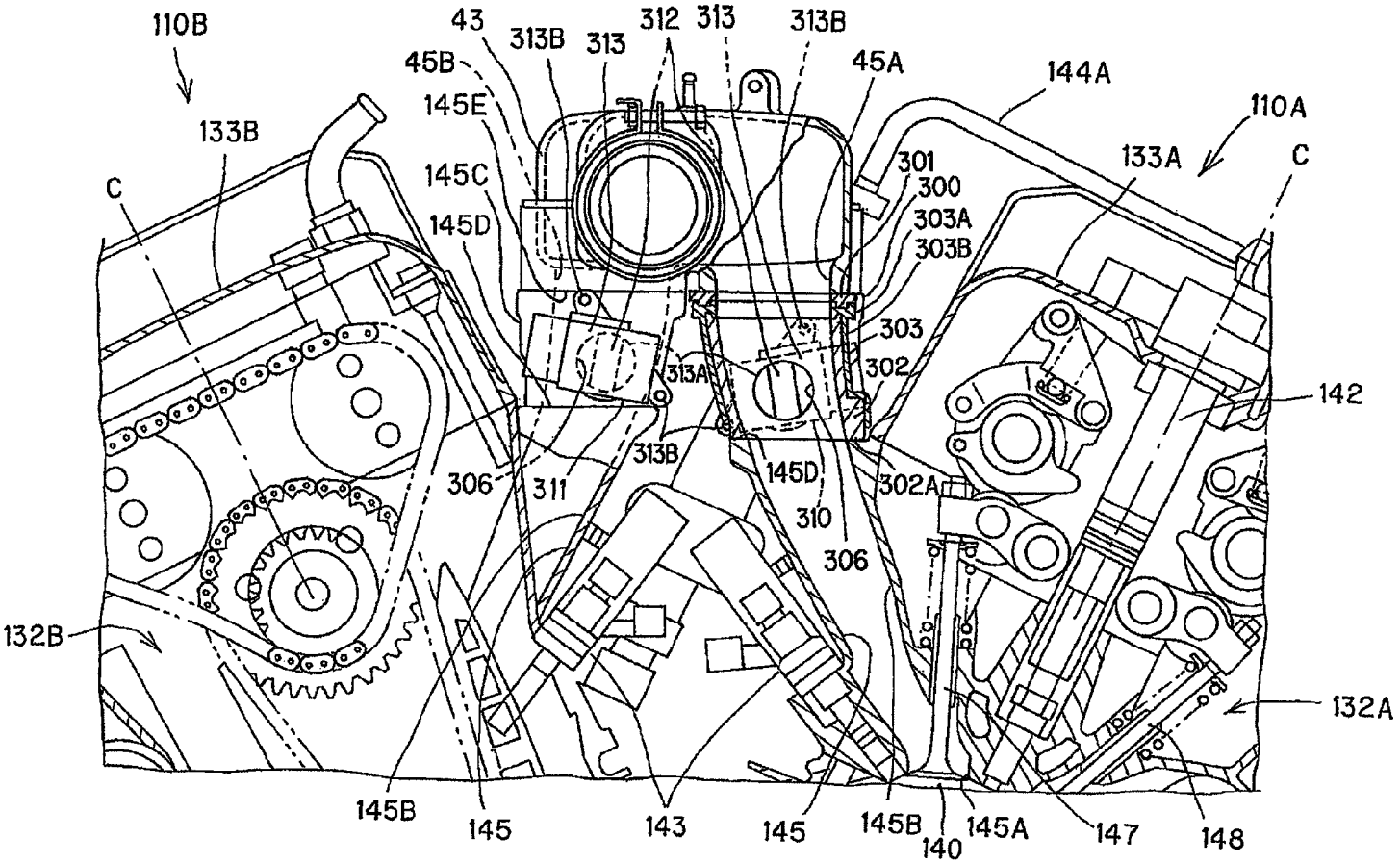
FIG. 11 is an enlarged side view showing an engine inlet system according to another embodiment.

FIG. 11 shows another embodiment. The same sections as those in FIG. 3 are shown by the same reference signs, and explanations thereof are omitted.

In the embodiment, a part of the upper inlet port 300 of the front bank 110A is formed of an elastic member. More specifically, the upper inlet port 300 is vertically divided into two, an upper side thereof is provided with a flange 301 connected to a lower surface of the inlet chamber 43, and a lower side thereof is provided with an inlet pipe 302 connected to the top end 145D of the lower inlet port 145B. The flange 301 and the inlet pipe 302 are formed by using metallic material such as aluminum. An elastic body 303 is disposed between the flange 301 and the inlet pipe 302.

The elastic body 303 is formed by burning the elastic member such as rubber on the surfaces of the flange 301 and the inlet pipe 302. The elastic body 303 is provided with a substantially annular base section 303A connecting the inlet pipe 302 to the flange 301 and an extended section 303B extending along the outer peripheral surface of the inlet pipe 302 from the base section 303A. Note that the extended section 303B covering the outer peripheral surface of the inlet pipe 302 may be omitted.

Intake volume sensors 310, 311 measuring air capacity led to flow into a combustion chamber 140 through the inlet port 145 can be respectively attached to the upper inlet ports 300, 145C. Each of the intake volume sensors 310, 311 is provided with a platelike sensor section 312, and a sensor base 313 to which a base end of the sensor section 312 is fixed. Each sensor base 313 is formed with an engagement section 313A formed into a substantially round shape in a side view and a plurality of fixing holes 313B (two in the embodiment). Each of the intake volume sensors 310, 311 is a hot-wire flow rate sensor which measures a flow rate by detecting a change in electric resistance of the sensor section 312 when air flowing around the sensor section 312 takes heat of the sensor section 312.

A side surface of each of the upper inlet ports 300, 145C is formed with a sensor mounting hole 306 communicating with an inlet passage through the side surface. The sensor mounting hole 306 of the upper inlet port 300 is passed through both the extended section 303B and the inlet pipe 302. The intake volume sensors 310, 311 are inserted from the outer sides of the upper inlet ports 300, 145C into the sensor mounting holes 306 and fixed with bolts (not shown) to be inserted into the fixing holes 313B with the engagement sections 313A engaged with the sensor mounting holes 306. Since the intake volume sensors 310, 311 are independently provided to the paired front and rear inlet ports 145, the intake volume led to flow into each combustion chamber 140 can be correctly measured even if the intake volumes led to flow into the paired front and rear inlet ports 145 are different from each other by an influence of disturbance or a difference in a shape of a channel.

Next, movements of the embodiment are explained.

Since the upper inlet port 300 of the front bank 110A is provided with the elastic body 303 formed of the elastic member, the elastic body 303 is elastically deformed and hence it is possible to further absorb the difference in level and angle of the interface between the paired front and rear inlet ports 145 and the inlet chamber 43 caused by angular tolerance of the banks 110A, 110B, dimensional tolerance of the cylinder blocks 131A, 131B and the cylinder heads 132A, 132B, or the like. Besides, since the elastic body 303 is formed between the flange 301 and the inlet pipe 302 of the upper inlet port 300 vertically divided into two, the base section 303A of the elastic body 303 is vertically elastically deformed and hence it is possible to easily adjust the vertical length of the upper inlet port 300. As a result, it is possible to further suppress the stress on the paired front and rear inlet ports 145 and the inlet chamber 43 and also to improve sealability. Accordingly, it is possible to prevent deterioration of output characteristics due to fresh air intake from the gap, and deterioration of fuel economy performance and emission performance. Also, since the length of the upper inlet port 300 can be adjusted, the inlet ports 145 connected from the inlet chamber 43 to the combustion chambers 140 of the front and rear banks 110A, 110B can be made substantially the same in length.

Since the elastic body 303 is provided to the upper inlet port 300 having a comparatively simple structure, it is possible to easily dispose the elastic body 303 in comparison with the case where the elastic body is provided to the inlet chamber 43 or the lower inlet port 145B having a comparatively complicated structure and also it is possible to prevent the structure of the inlet chamber 43 and the lower inlet port 145B from being more complicated.

Further, since only the elastic body 303 of the upper inlet port 300 is formed of the elastic member, it is possible to ensure rigidity enduring weight of the inlet chamber 43 and depression at engine manifold by, for example, forming the flange 301 and the inlet pipe 302 using rigid material such as metallic material.

According to the embodiment, since a part (the elastic body 303) of the upper inlet port 300 of the front bank 110A is formed of the elastic member, the elastic member is elastically deformed and hence it is possible to further absorb the difference in level and angle of the interface between the paired front and rear inlet ports 145 and the inlet chamber 43. Accordingly, it is possible to further suppress the stress on the interface and also to improve sealability. Also, since only the elastic body 303 of the upper inlet port 300 is formed of the elastic member, it is possible to ensure the necessary rigidity of the upper inlet port 300.

Since the upper inlet port 300 is vertically divided into two and the elastic body 303 is formed between the divided upper inlet ports, the elastic member 303 is vertically elastically deformed and hence it is possible to easily adjust the vertical length of the upper inlet port 300. Accordingly, it is possible to further suppress the stress on the interface and also to improve sealability.

Since the elastic body 303 is formed by burning rubber on the surfaces of the metallic inlet pipe 302 and flange 301, the elastic body 303 is integrated with the upper inlet port 300 divided into two. Accordingly, it is possible to handle the upper intake port 300 as one component and to easily attach and detach the upper inlet port 300.

As a matter of course, it is possible to appropriately change the above embodiment without departing from the scope of the present invention.

For example, in the above embodiment, although the upper inlet port 300 is so configured that the upper side thereof is provided with the flange 301 and the lower side thereof is provided with the inlet pipe 302, the upper side thereof may be provided with the inlet pipe and the lower side thereof may be provided with the flange.

Also, in the above embodiment, although only the elastic body 303 of the upper inlet port 300 is formed of the elastic body, the whole upper inlet port may be formed of the elastic member.

Further, in the above embodiment, although the elastic member is used for the inlet port 145 provided with the intake volume sensor 310, the elastic member may be used for the inlet port 145 having no intake volume sensor 310 as shown in FIG. 3.

Furthermore, in the above embodiment, although the elastic member is used for the upper inlet port 300 of the front bank 110A, the elastic member may be used for the upper inlet port of the rear bank 110B.

Still further, in the above embodiment, although the engine 17 is the V-type two cylinder water-cooled engine, it is not limited thereto. The inlet port 145 having the upper inlet port 145C and the lower inlet port 145B or the inlet port 145 having the upper inlet port 300 and the lower inlet port 145B may be provided in the V-type engine having more than three cylinders.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inlet passage structure of a V-type internal combustion engine in a vehicle body, the engine having a pair of front and rear banks disposed in a shape of V, with a cylinder center line CA of in a front-to-back direction of the vehicle body being offset in a right direction of the vehicle body, and a cylinder center line CB of the rear bank in the front-to-back direction of the vehicle body being offset in a left direction of the vehicle body, an inlet chamber downstream of a throttle body commonly shared by the front and rear banks, and an inlet pipe branched from the inlet chamber to a combustion chamber of each of the front and rear banks, the inlet passage structure comprising:

an inlet port provided to each of the front and rear banks and having a nearly identical inlet passage length, wherein the inlet chamber is connected to a top end opening of the inlet port;

the throttle body includes two inlet paths, the throttle body and the inlet chamber are offset on a side leading to a cylinder on a side away from the throttle body, the throttle body being arranged being offset so that the two inlet paths have identical lengths; and an inside of the inlet chamber is formed with a nearly straight inlet passage from the throttle body to the top end opening of the inlet port leading to the cylinder on the side away from the throttle body and a curved inlet passage to the top end opening of the inlet port leading to a cylinder on a close side.

2. The inlet passage structure of a V-type internal combustion engine according to claim 1, wherein the throttle body has an actuator to control a degree of opening of the throttle body on a side opposite to a direction of the offset.

3. The inlet passage structure of a V-type internal combustion engine according to claim 1, wherein a camshaft is disposed independently for inlet and exhaust in a cylinder head on each cylinder block;

a rocker arm to drive an inlet and exhaust valve by driving force transferred from a camshaft is disposed; and a rocker arm pivot of the rocker arm is disposed on a center side of the cylinder head.

4. The inlet passage structure of a V-type internal combustion engine according to claim 3, wherein an end of the rocker arm on the center side is notched along a shape of a plug hole for an ignition plug.

5. The inlet passage structure of a V-type internal combustion engine according to claim 1, wherein the cylinder bores of the front and rear banks are also disposed so as to be offset from each other in an axial direction of a crankshaft of the engine.

6. The inlet passage structure of a V-type internal combustion engine according to claim 1, wherein the each of inlet ports has a lower inlet port integrated with a cylinder head and an upper inlet port not integrated with the cylinder head and connected to a top end of the lower inlet port; and the upper inlet port extends in the manner of changing an angle to a direction closer to a head cover of the cylinder head.

7. The inlet passage structure of a V-type internal combustion engine according to claim 6, wherein the upper inlet ports of the paired front and rear banks extend upward nearly parallel with each other; and an inlet chamber disposed inside the V bank is connected to the top end of each upper inlet port.

8. The inlet passage structure of a V-type internal combustion engine according to claim 6, wherein a fuel injection device is disposed below and along the lower inlet port.

9. The inlet passage structure of a V-type internal combustion engine according to claim 6, wherein one of the upper inlet ports of the paired front and rear banks is formed of an elastic member.

10. The inlet passage structure of a V-type internal combustion engine according to claim 6, wherein at least a part of one of the upper inlet ports of the paired front and rear banks is formed of an elastic member.

11. The inlet passage structure of a V-type internal combustion engine according to claim 10, wherein the upper inlet port is vertically divided into two and the elastic member is formed between the divided inlet ports.

12. The inlet passage structure of a V-type internal combustion engine according to claim 11, wherein the elastic member is formed by burning rubber on a surface of metal.

13. An inlet passage structure of a V-type internal combustion engine in a vehicle body, the engine having a pair of front and rear banks disposed in a shape of V, with a cylinder center line CA of in a front-to-back direction of the vehicle body being offset in a right direction of the vehicle body, and a cylinder center line CB of the rear bank in the front-to-back direction of the vehicle body being offset in a left direction of the vehicle body, comprising:

an inlet chamber downstream of a throttle body commonly shared by the front and rear banks, and an inlet pipe branched from the inlet chamber to a combustion chamber of each of the front and rear banks, wherein each of the front and rear banks has an inlet port having nearly identical inlet passage length and the inlet chamber is connected to a top end opening of the inlet port;

the throttle body includes two inlet paths, the throttle body and the inlet chamber are offset on a side leading to a cylinder on a side away from the throttle body, the throttle body being arranged being offset so that the two inlet paths have identical lengths; and an inside of the inlet chamber is formed with a nearly straight inlet passage from the throttle body to the top end opening of the inlet port leading to the cylinder on the side away from the throttle body and a curved inlet passage to the top end opening of the inlet port leading to a cylinder on a close side.

14. The inlet passage structure of a V-type internal combustion engine according to claim 13, wherein the throttle body has an actuator to control a degree of opening of the throttle body on a side opposite to a direction of the offset.

15. The inlet passage structure of a V-type internal combustion engine according to claim 13, wherein a camshaft is disposed independently for inlet and exhaust in a cylinder head on each cylinder block;

a rocker arm to drive an inlet and exhaust valve by driving force transferred from a camshaft is disposed; and a rocker arm pivot of the rocker arm is disposed on a center side of the cylinder head.

16. The inlet passage structure of a V-type internal combustion engine according to claim 15, wherein an end of the rocker arm on the center side is notched along a shape of a plug hole for an ignition plug.

17. The inlet passage structure of a V-type internal combustion engine according to claim 13, wherein the cylinder bores of the front and rear banks are also disposed so as to be offset from each other in an axial direction of a crankshaft of the engine.

18. The inlet passage structure of a V-type internal combustion engine according to claim 13, wherein the each of inlet ports has a lower inlet port integrated with a cylinder head and an upper inlet port not integrated with the cylinder head and connected to a top end of the lower inlet port; and the upper inlet port extends in the manner of changing an angle to a direction closer to a head cover of the cylinder head.

19. The inlet passage structure of a V-type internal combustion engine according to claim 18, wherein the upper inlet ports of the paired front and rear banks extend upward nearly parallel with each other; and an inlet chamber disposed inside the V bank is connected to the top end of each upper inlet port.

20. The inlet passage structure of a V-type internal combustion engine according to claim 18, wherein a fuel injection device is disposed below and along the lower inlet port.

* * * * *